US012465139B1

(12) United States Patent
Graham

(10) Patent No.: US 12,465,139 B1
(45) Date of Patent: Nov. 11, 2025

(54) COLLAPSIBLE WORK STAND WITH ADJUSTABLE PLATFORMS

(71) Applicant: Michael Wayne Graham, New York, NY (US)

(72) Inventor: Michael Wayne Graham, New York, NY (US)

( * ) Notice: Subject to any disclaimer, the term of this patent is extended or adjusted under 35 U.S.C. 154(b) by 0 days.

(21) Appl. No.: 19/039,785

(22) Filed: Jan. 29, 2025

(51) Int. Cl.

| | |
|---|---|
| ***A47B 3/12*** | (2006.01) |
| ***A47B 3/06*** | (2006.01) |
| ***A47B 3/083*** | (2006.01) |
| ***A47B 3/10*** | (2006.01) |
| ***A47B 21/02*** | (2006.01) |
| *A47B 9/00* | (2006.01) |

(52) U.S. Cl.
CPC ..... *A47B 3/12* (2013.01); *A47B 3/06* (2013.01); *A47B 3/083* (2013.01); *A47B 3/10* (2013.01); *A47B 21/02* (2013.01); *A47B 2009/003* (2013.01); *A47B 2200/0046* (2013.01); *A47B 2200/0052* (2013.01); *A47B 2200/0075* (2013.01)

(58) Field of Classification Search
CPC .. A47B 3/12; A47B 3/06; A47B 3/083; A47B 3/10; A47B 21/02; A47B 2009/003; A47B 2200/0046; A47B 2200/0052; A47B 2200/0075
See application file for complete search history.

(56) References Cited

U.S. PATENT DOCUMENTS

| | | | | |
|---|---|---|---|---|
| 108,046 | A * | 10/1870 | Palimenberg | D06F 57/04 211/173 |
| 2,433,748 | A * | 12/1947 | Eide | A47F 5/10 211/187 |
| 4,109,961 | A * | 8/1978 | Opsvik | A47D 1/002 D6/350 |
| 5,088,420 | A | 2/1992 | Russell | |
| 5,435,620 | A * | 7/1995 | Cheng | A47C 4/20 297/51 |
| D436,760 | S | 1/2001 | Dow | |
| 6,819,548 | B2 | 11/2004 | Hillis | |
| D774,812 | S | 12/2016 | Nafziger | |
| 9,642,452 | B2 | 5/2017 | Fecheyr-Lippens | |

(Continued)

FOREIGN PATENT DOCUMENTS

JP 10201545 A * 8/1998

*Primary Examiner* — Eret C McNichols
(74) *Attorney, Agent, or Firm* — Esplin & Associates, PC

(57) ABSTRACT

Stands for collapsible work stands and related methods are described. In some implementations, a stand may be configured to support electronics for a user, featuring a base structure designed to rest on a generally horizontal surface. The stand may include a pair of stanchions, each with a proximate end secured by the base and extending upward to a distal end, with the first stanchion tilting away from the user and the second stanchion being generally parallel to the first. A first platform may be provided to hold electronics, with a height adjustment mechanism allowing the platform's horizontal position to be adjusted along the stanchions. A second platform with its own height adjustment mechanism may be configured to hold additional electronics. Both platforms' positions may be adjustable between the proximate and distal ends of the stanchions, providing a versatile and user-friendly work stand.

20 Claims, 13 Drawing Sheets

(56) References Cited

U.S. PATENT DOCUMENTS

| | | | | |
|---|---|---|---|---|
| D832,621 | S | 11/2018 | Shaw | |
| 10,413,053 | B2 | 9/2019 | Flaherty | |
| 11,925,256 | B2 * | 3/2024 | Leng | A47B 3/0809 |
| 2008/0041683 | A1 * | 2/2008 | Dorquez | A45C 9/00 190/11 |
| 2018/0132606 | A1 * | 5/2018 | Long, Jr. | A47B 5/04 |

* cited by examiner

COLLAPSIBLE WORK STAND WITH ADJUSTABLE PLATFORMS

FIELD OF TECHNOLOGY

The present disclosure relates generally to collapsible work stands, and more specifically to collapsible work stands with adjustable platforms.

BACKGROUND

In the field of work stands and support structures for electronic devices, various designs have been developed to accommodate laptops, tablets, and smartphones. These stands may include features such as adjustable viewing angles and heights to enhance user comfort and ergonomics. Some stands may offer collapsibility for ease of transport and storage, while others may focus on providing a stable base and support for the electronic devices. The design of these stands may incorporate mechanisms that allow for the adjustment of the device's position relative to the user, which may include tilting or height alteration capabilities. Additionally, the construction of these stands may vary, with some utilizing lightweight materials for portability and others opting for more robust materials to increase stability and durability.

SUMMARY

The described implementations relate to improved collapsible work stands and associated methods for collapsible work stands with adjustable platforms. In some examples, a collapsible work stand may feature two stanchions supporting adjustable platforms, each with a unique height adjustment mechanism. This design may allow users to customize the height of their electronic devices with ease, promoting an ergonomic workspace that can be tailored to individual needs. The first platform may be ideal for holding a laptop at or near eye level, while the second platform may be designed to accommodate a keyboard and/or mouse at a lower position (i.e., at or slightly below elbow level), enhancing the overall comfort and usability of the stand. The stand enables the user to quickly and easily transition between working in a seated position and working in a standing position.

The stand's base structure may be engineered to provide stability when deployed, yet it can be folded into a flat configuration for storage or transport. This innovative approach to the base design, coupled with the extendible stanchions, ensures that the stand remains lightweight and portable without compromising on the robustness required for secure device support. The platforms may connect to the stanchions through openings lined with a friction material, allowing for smooth vertical adjustment and secure positioning once the desired height is achieved. By simply tilting the platforms, users may release the friction hold and reposition them as needed, then return them to a horizontal position to re-engage the secure hold. This approach may effectively bridge the gap between portability and ergonomic customization, providing a versatile stand that meets the dynamic needs of modern users.

A collapsible work stand configured to be deployed to hold the electronics of a user during use of the electronics is described. The stand may include a base structure configured to support the stand upon a generally horizontal surface during deployment of the stand, the base structure having a front end and a rear end, the front end facing toward a side of the stand at which the user is positioned during use of the electronics and the rear end facing opposite the front end. The stand may include a first stanchion with a distal end and a proximate end opposite the distal end, wherein during deployment the proximate end of the first stanchion is secured by the base structure with the first stanchion extending upward away from the base structure to the distal end such that the first stanchion tilts away from the user during use of the electronics. The stand may include a second stanchion with a distal end and a proximate end opposite the distal end, wherein during deployment the proximate end of the second stanchion is secured by the base structure with the second stanchion extending upward away from the base structure to the distal end such that the second stanchion is generally parallel with the first stanchion. The stand may include a first platform configured to hold at least a portion of the electronics during deployment. The stand may include a first platform height adjustment mechanism configured to hold the first platform in a generally horizontal position along the first stanchion and the second stanchion above the base structure, the first platform height adjustment mechanism being adapted so the horizontal position of the first platform is adjustable along the lengths of the first stanchion and the second stanchion between the proximate ends and the distal ends. The stand may include a second platform configured to hold at least a portion of the electronics during deployment. The stand may include a second platform height adjustment mechanism configured to hold the second platform in a generally horizontal position along the first stanchion and the second stanchion above the base, the second platform height adjustment mechanism being adapted so the horizontal position of the second platform is adjustable along the lengths of the first stanchion and the second stanchion between the proximate and distal ends.

A method of using a collapsible work stand to hold the electronics of a user is described. The method may include positioning a base structure of the stand upon a generally horizontal surface, wherein the base structure has a front end facing toward a side of the stand at which the user is positioned during use of the electronics and a rear end facing opposite the front end. The method may include securing a proximate end of a first stanchion by the base structure and extending the first stanchion upward away from the base structure to a distal end such that the first stanchion tilts away from the user. The method may include securing a proximate end of a second stanchion by the base structure and extending the second stanchion upward away from the base structure to a distal end such that the second stanchion is generally parallel with the first stanchion. The method may include adjusting the height of the first platform to a generally horizontal position along the first stanchion and the second stanchion above the base, wherein the adjustment is performed by a first platform height adjustment mechanism adapted to allow the horizontal position of the first platform to be adjustable along the lengths of the first stanchion and the second stanchion between the proximate ends and the distal ends. The method may include placing at least a portion of the electronics on a first platform during the deployment of the stand. The method may include adjusting the height of the second platform to a generally horizontal position along the first stanchion and the second stanchion above the base, wherein the adjustment is performed by a second platform height adjustment mechanism adapted to allow the horizontal position of the second platform to be adjustable along the lengths of the first stanchion and the second stanchion between the proximate and distal ends. The method may include placing at least a portion of the electronics on a second platform during the deployment of the stand.

In some examples of the technologies and related methods described herein, the first platform height adjustment mechanism may include two openings of the first platform that allow the first stanchion and the second stanchion to pass through respectively.

In some examples of the technologies and related methods described herein, borders of the two openings of the first platform may be lined with a material such that friction between the material contacting with the first stanchion and the second stanchion secures the first platform in the generally horizontal position.

In some examples of the technologies and related methods described herein, the two openings of the first platform may be shaped such that tilting the first platform releases the borders of the two openings from contact with the first stanchion and second stanchion and facilitates movement of the first platform along the lengths of the first stanchion and the second stanchion between the proximate ends and the distal ends.

In some examples of the technologies and related methods described herein, returning the first platform to the generally horizontal position may restore contact between the borders of the two openings and the first stanchion and the second stanchion to secure the first platform at the desired position along the lengths of the first stanchion and the second stanchion between the proximate ends and the distal ends.

In some examples of the technologies and related methods described herein, the second platform height adjustment mechanism may include two openings of the second platform that allow the first stanchion and the second stanchion to pass through respectively.

In some examples of the technologies and related methods described herein, borders of the two openings of the second platform may be lined with a material such that friction between the material contacting with the first stanchion and the second stanchion secures the second platform in the generally horizontal position.

In some examples of the technologies and related methods described herein, the two openings of the second platform may be shaped such that tilting the second platform releases the borders of the two openings from contact with the first stanchion and second stanchion and facilitates movement of the second platform along the lengths of the first stanchion and the second stanchion between the proximate ends and the distal ends.

In some examples of the technologies and related methods described herein, returning the second platform to the generally horizontal position may restore contact between the borders of the two openings and the first stanchion and the second stanchion to secure the second platform at the desired position along the lengths of the first stanchion and the second stanchion between the proximate ends and the distal ends.

In some examples of the technologies and related methods described herein, the first stanchion and the second stanchion may be telescopically extendible such that the first stanchion and the second stanchion are retracted during storage of the stand and extended during deployment of the stand.

In some examples of the technologies and related methods described herein, the first stanchion and the second stanchion may be formed of two or more connectible stanchion segments such that the two or more connectible stanchion segments are detached during storage of the stand and rigidly connected during deployment of the stand.

In some examples of the technologies and related methods described herein, the individual stanchions may be formed of a rigid material.

In some examples of the technologies and related methods described herein, the first platform and the second platform may be removable from the first stanchion and second stanchion during storage of the stand, and the first platform may be configured to stack atop the folded second platform during storage.

In some examples of the technologies and related methods described herein, the second platform may be comprised of a first section and a second section connected by a hinge along which the second platform folds. The second platform may include a locking mechanism positioned on an underside of the second platform, and the locking mechanism may include a track positioned between the first section and the second section of the second platform and a knob that is slidable along the track. The knob may have a threaded member that facilitates tightening of the knob along the track, and the knob may be coupled with a slidable bar that moves along the track with the knob.

In some examples of the technologies and related methods described herein, the base structure may include a first base support bar pivotally connected to the first base strut and a second base support bar pivotally connected to the second base strut. Each base support bar may include a base support hinge for folding into a compact arrangement. The first base support bar and the second support bar may be connected by one or more connecting support bars.

In some examples of the technologies and related methods described herein, the second platform may comprise a first platform fastener positioned on the first edge of the second platform. The first platform fastener may be configured to engage with a second platform fastener positioned on a third edge of the second platform opposite the first edge subsequent to the second platform being folded along a platform hinge. The first platform fastener may be configured to engage with the second platform fastener to secure the second platform in a folded configuration for storage.

In some examples of the technologies and related methods described herein, the second platform may include platform hinges positioned near the second edge of the second platform and the fourth edge of the second platform, facilitating the folding of the second platform for enhanced portability.

In some examples of the technologies and related methods described herein, the second platform may include one or more stanchion segment slots on the underside of the second platform. The segment slots may be configured to receive one or more stanchion segments for modular assembly.

DETAILED DESCRIPTION

Figure 1:
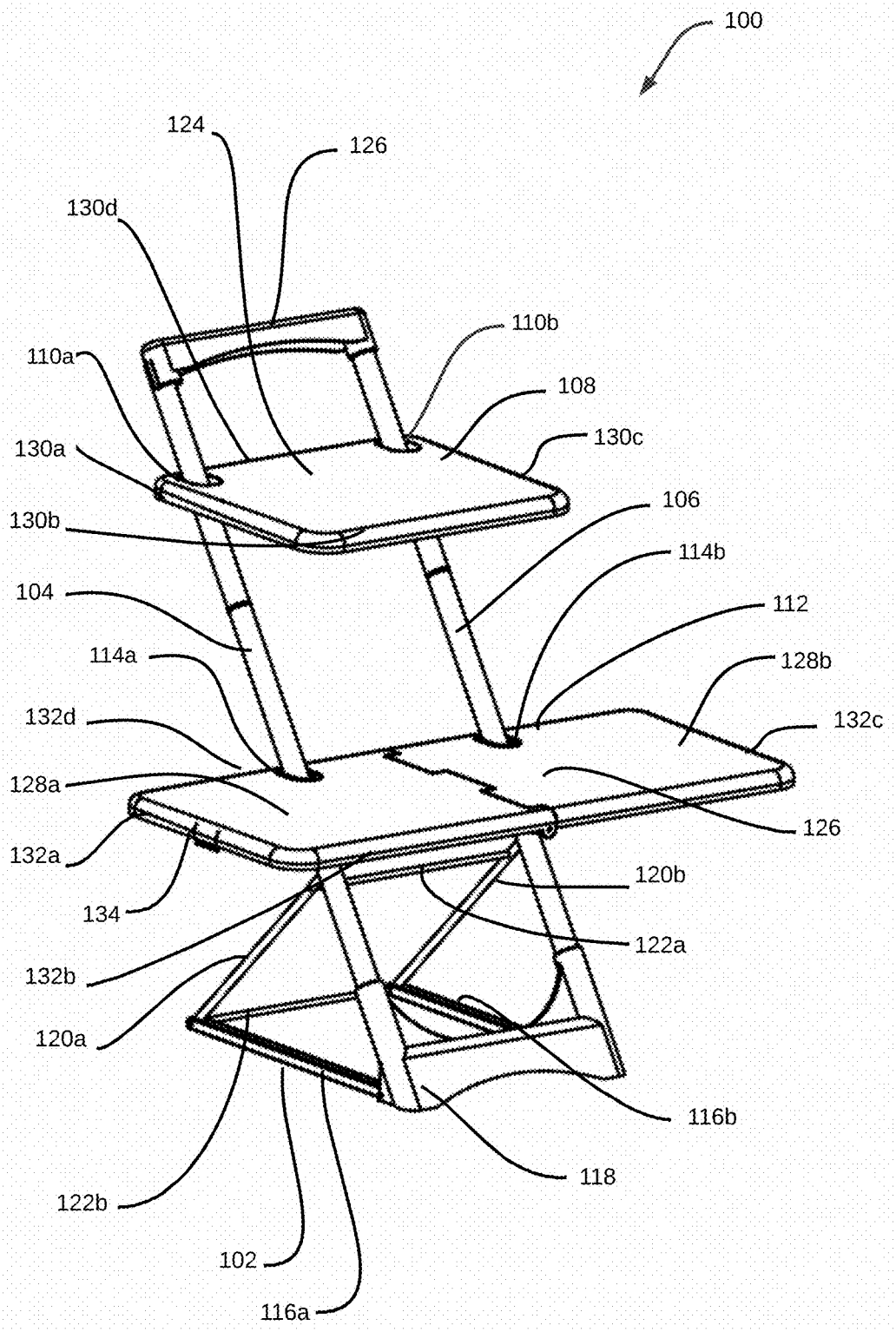
FIG. 1 shows a collapsible work stand with adjustable platforms in accordance with various aspects of the present disclosure.

The described implementations relate to improved collapsible work stands and associated methods for collapsible work stand with adjustable platforms. In some examples, the limitations of current work stands present a significant problem for users who may require a customizable and ergonomic solution that is also portable. Users often struggle to find a stand that can be easily adjusted to their preferred height, which may lead to discomfort and potential ergonomic issues during prolonged use. Furthermore, the need for a stand that can be quickly collapsed and transported without sacrificing stability is a growing demand in a mobile-centric world. The existing solutions either fail to offer the necessary adjustability and ease of use or do not provide a stable and durable platform when configured to be portable.

According to some implementations, a collapsible work stand may be configured to support various electronics, such as laptops, in a user-friendly manner. This work stand may include a base structure that is designed to rest upon a generally horizontal surface when in use. The base structure may have a front end that faces the user and a rear end that is opposite the front end. For convenience in storage and transport, the base structure may be capable of folding flat, featuring pivotal connections and supports that engage with vertical supports known as stanchions.

The stanchions may extend upward from the base structure and are responsible for supporting two separate platforms, one positioned above the other. These stanchions may be extendible, either by a telescoping action or by the addition and removal of segments, to transition from a compact storage form to a deployed state. They may be connected and held in a parallel configuration by connectors, particularly at an end opposite the base. The stanchions may be arranged at an angle to the vertical, leaning from the front to the back of the base, and are constructed from a lightweight yet rigid material.

The platforms may serve different purposes, with the first platform being configured to hold a laptop at or near eye level, and the second platform designed to hold additional electronics or accessories such as a keyboard and mouse below the first platform. Both platforms may be detachable from the stanchions for ease of storage. The second platform may have the added functionality of folding for storage and may include a locking mechanism to secure it in place during use. The second platform's locking mechanism may feature a track, a knob with a threaded member for tightening, and a slidable bar that moves with the knob and formed of a rigid material to maintain the platform's position during use.

Each platform may be equipped with its own height adjustment mechanism, which allows for vertical positioning along the stanchions for the comfort of the user. These mechanisms may involve openings in the platforms that the stanchions pass through. The borders of these openings may be lined with a material that grips the stanchions due to friction when the platforms are brought to a horizontal position. By tilting the platforms, they may be released from the stanchions, allowing for movement up or down to adjust the height. Once the desired height is achieved, returning the platforms to a horizontal position may re-engage the friction material to secure the platforms.

Additional features of the work stand may include a stanchion connector at the distal ends to maintain the stanchions in a parallel configuration during deployment. The base structure may comprise base struts that are pivotally attached to a stanchion support and base supports. These base supports may engage with the stanchions to provide stability during deployment.

Aspects of the subject matter described in this disclosure can be implemented to realize one or more of the following potential advantages. The described techniques may be implemented to support enhanced user ergonomics by allowing the height of the platforms to be adjusted to suit individual preferences, which may contribute to better posture and reduced strain during extended periods of use. The collapsible nature of the work stand may offer convenience in terms of portability and storage, enabling users to easily transport and set up their work environment in various locations. The locking mechanism of the second platform may provide stability and security for the electronics placed upon it, ensuring that they remain in the desired position even during vigorous typing or other interactions. The use of lightweight materials for the stanchions may result in a work stand that is easy to handle yet sufficiently sturdy to support the weight of the electronics. The ability to fold the base flat may facilitate the work stand's integration into environments with limited space, allowing for a temporary setup that can be quickly dismantled and stored away when not in use. The friction material lining the openings of the platforms may offer a simple yet effective means of adjusting the height without the need for complex or bulky mechanisms, contributing to the overall sleek and minimalistic design of the work stand.

Aspects of the disclosure are initially described in the context of collapsible work stands. Aspects of the disclosure are additionally illustrated by and described with reference to example implementations. Aspects of the disclosure are further described with reference to a flowchart that illustrates a method of using a collapsible work stand with adjustable platforms and foldable base structure.

FIG. 1 shows an adjustable platform structure 100 which supports techniques for collapsible work stand with adjustable platforms in accordance with various aspects of the present disclosure. As depicted in FIG. 1, the adjustable platform structure 100 may include one or more of a base structure 102, a first stanchion 104, a second stanchion 106, a first platform 108, a first platform height adjustment mechanism 110*a-b*, a second platform 112, a second platform height adjustment mechanism 114*a-b*, and/or other components.

The base structure 102 may serve as the foundational support for the adjustable platform structure 100. The base structure 102 may be designed to maintain stability of the adjustable platform structure 100 when in use. The base structure 102 may be constructed from materials that contribute to the overall durability of the adjustable platform structure 100. For example, the base structure 102 may be made of metal, plastic, or a composite material. The base structure 102 may comprise a first base strut 116*a*, a second base strut 116*b*, a stanchion support 118, a first base support bar 120*a*, a second base support bar 120*b*, a first connecting base support bar 122*a*, a second connecting base support bar 122*b*, and/or other components.

The first stanchion 104 may extend upward from the base structure 102 to provide vertical support for the platforms. The first stanchion 104 may be configured to connect with the base structure 102 in a manner that allows for secure attachment. The first stanchion 104 may be configured to be inserted into stanchion support 118. The first stanchion 104 may be designed to withstand the weight of electronics placed on the platforms. An example of the first stanchion 104 could be a metallic rod or a reinforced plastic beam.

The second stanchion 106 may be positioned parallel to the first stanchion 104 to ensure stability and support for the platforms. The second stanchion 106 may be configured to be inserted into stanchion support 118. The second stanchion 106 may be identical or similar in construction to the first stanchion 104 to maintain a cohesive design. The second stanchion 106 may be spaced apart from the first stanchion 104 at a distance that is suitable for the size of the platforms. The second stanchion 106, for instance, may be another metallic rod or a reinforced plastic beam that matches the first stanchion 104. Additional features of the work stand may include a stanchion connector 126 at the distal ends to maintain the stanchions in a parallel configuration during deployment.

The first platform 108 may be positioned along the stanchions 104, 106 to hold various electronics at a suitable height. The first platform 108 may have a first edge 130*a*, a second edge 130*b*, a third edge 130*c*, and a fourth edge 130*d*. The first platform 108 may be designed with a surface 124 that accommodates a range of electronic devices, such as a laptop. The surface 124 of first platform 108 may include features that prevent slipping or sliding of the electronics. As an example, the first platform 108 may have a textured surface or rubberized grips.

The first platform height adjustment mechanism 110*a-b* may allow for the vertical positioning of the first platform 108 along the stanchions 104, 106. The first platform height adjustment mechanism 110*a-b* may be integrated into the design of the first platform 108 to enable movement along the stanchions 104, 106. The first platform height adjustment mechanism 110*a-b* may involve components that interact with the stanchions 104, 106 to lock the first platform 108 in place. For instance, the first platform height adjustment mechanism 110*a-b* may include a series of notches or a clamping system.

The second platform 112 may be positioned below the first platform 108 to hold additional electronics or accessories. The second platform 112 may have a first edge 132*a*, a second edge 132*b*, a third edge 132*c*, and a fourth edge 132*d*. The second platform 112 may be designed to complement the first platform 108 in terms of size and functionality. The second platform 112 may have a surface 126 that is conducive to supporting various types of accessories, such as a keyboard and mouse. An alternative to the second platform 112 could be a tray or shelf with adjustable dividers. The second platform 112 may have a first section 128*a* and a second section 128*b*. The second platform 112 may include one or more fasteners 134 that facilitate locking the second platform 112 in a folded configuration.

The second platform height adjustment mechanism 114*a-b* may allow for the vertical positioning of the second platform 112 along the stanchions 104, 106. The second platform height adjustment mechanism 114*a-b* may operate independently of the first platform height adjustment mechanism 110*a-b*. The second platform height adjustment mechanism 114*a-b* may include elements that permit fine-tuning of the second platform's 112 height. For example, the second platform height adjustment mechanism 114*a-b* may include a series of notches or a clamping system.

In some implementations, the first platform 108 may be connected to the first stanchion 104 and the second stanchion 106 through the first platform height adjustment mechanism 110*a-b*, allowing it to be positioned at various heights. The second platform 112 may be similarly connected to the first stanchion 104 and the second stanchion 106 through the second platform height adjustment mechanism 114*a-b*, enabling independent height adjustments.

Figure 2:
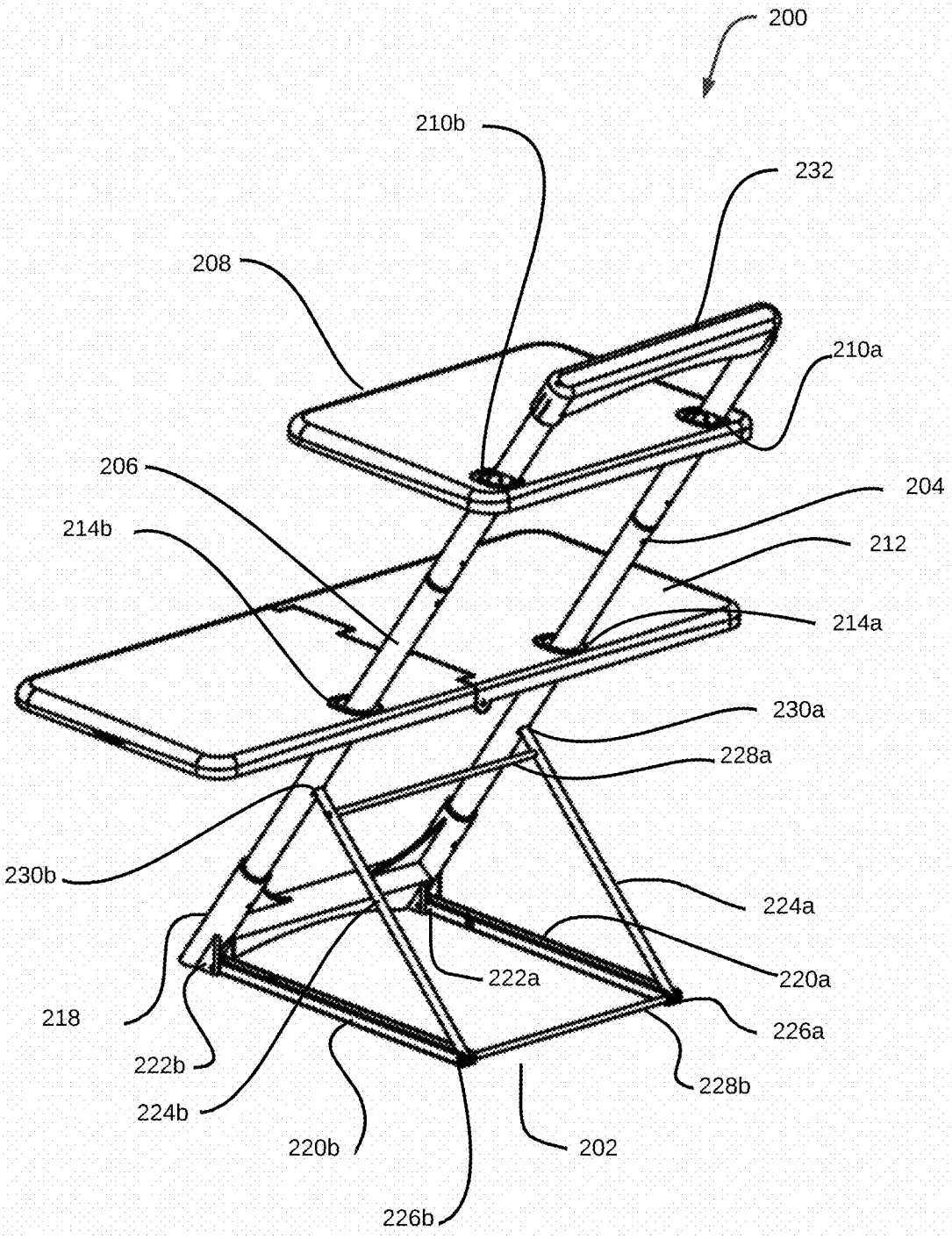
FIG. 2 shows a collapsible work stand with adjustable platforms in accordance with various aspects of the present disclosure.

FIG. 2 shows an adjustable platform stand 200 which supports techniques for collapsible work stand with adjustable platforms in accordance with various aspects of the present disclosure. As depicted in FIG. 2, the adjustable platform stand 200 may include one or more of a base structure 202, a first stanchion 204, a second stanchion 206, a first platform 208, a first platform height adjustment mechanism 210*a-b*, a second platform 212, a second platform height adjustment mechanism 214*a-b*, and/or other components.

The base structure 202 may provide a stable foundation for the adjustable platform stand 200 when deployed. The base structure 202 may be designed to rest upon a generally horizontal surface, such as a desk or table. The base structure 202 may be comprised of materials that contribute to the overall stability of the adjustable platform stand 200. The base structure 202 may interact with other components of the adjustable platform stand 200 to maintain the structure's integrity when in use. For instance, the base structure 202 may include features that allow it to engage with the first stanchion 204 and the second stanchion 206.

The first stanchion 204 may extend vertically from the base structure 202 to support the first platform 208 and the second platform 212. The first stanchion 204 may be constructed to withstand the weight of items placed on the first platform 208 and the second platform 212. The first stanchion 204 may be made from a variety of materials, such as metal or reinforced plastic, which may contribute to its supportive properties. The first stanchion 204 may be positioned in such a way that it aligns with the second stanchion 206 to form a parallel arrangement.

The second stanchion 206 may be positioned parallel to the first stanchion 204 to provide additional support for the platforms. The second stanchion 206 may be identical or similar in design to the first stanchion 204 to maintain a cohesive look and function. The second stanchion 206 may be made from materials that match or complement those of the first stanchion 204. The parallel positioning of the second stanchion 206 with the first stanchion 204 may contribute to the balanced distribution of weight across the adjustable platform stand 200. Additional features of the work stand may include a stanchion connector 232 at the distal ends to maintain the stanchions in a parallel configuration during deployment.

The first platform 208 may serve as a level surface for placement of various items. The first platform 208 may be designed with a flat surface area to accommodate objects such as laptops. The first platform 208 may be constructed from materials that provide a sturdy yet lightweight surface. The first platform 208 may be connected to the first stanchion 204 and the second stanchion 206 in a manner that allows for height adjustments.

The first platform height adjustment mechanism 210*a-b* may allow for vertical positioning of the first platform 208 along the stanchions 204 and 206. The first platform height adjustment mechanism 210*a-b* may include components that interact with the first stanchion 204 and the second stanchion 206 to secure the first platform 208 at various heights. The first platform height adjustment mechanism 210*a-b* may be designed to be user-friendly, allowing for easy adjustments by the user. The first platform height adjustment mechanism 210*a-b* may consist of a series of notches, clamps, or other features that engage with the stanchions 204 and 206 to hold the first platform 208 in place.

The second platform 212 may offer an additional level surface for placement of items below the first platform 208. The second platform 212 may be designed to complement the first platform 208 in terms of size and shape. The second platform 212 may be constructed to be durable and capable of supporting various items such as a keyboard and mouse or other peripherals. The second platform 212 may be attached to the stanchions 204 and 206 in a way that allows it to be adjusted independently of the first platform 208.

The second platform height adjustment mechanism 214*a-b* may enable vertical positioning of the second platform 212 along the stanchions 204 and 206. The second platform height adjustment mechanism 214*a-b* may incorporate elements that permit the second platform 212 to be moved up or down to suit the user's needs. The second platform height adjustment mechanism 214*a-b* may be similar in operation to the first platform height adjustment mechanism 210*a-b*, providing a consistent user experience. The second platform height adjustment mechanism 214*a-b* may include a locking feature to secure the second platform 212 at the desired height.

In some implementations, the base structure 202 may include a stanchion support 218 configured to hold the first stanchion 204 and the second stanchion 206. The base structure may include a first base strut 220*a*, a second base strut 220*b*, a first base support bar 224*a*, a second base support bar 224*b*, and/or other components. Each of the base struts 220*a-b* may be connected to stanchion support 218 by stanchion support hinges 222*a-b*. Each of the base struts 220*a-b* may be connected to individual base support bars 224*a-b* by base support hinges 226*a-b*. The stanchion support hinges 222*a-b* and the base support hinges 226*a-b* may facilitate folding of the base structure 202 for storage. The first base support bar 224*a* may be connected to the second base support bar 224*b* by one or more connecting base support bars 228*a-b*. The first base support bar 224*a* may be configured to be inserted into a first opening 230*a* of first stanchion 204 to maintain the structure of base support 202. The second base support bar 224*b* may be configured to be inserted into a second opening 230*b* of second stanchion 206 to maintain the structure of base support 202.

Figure 3:
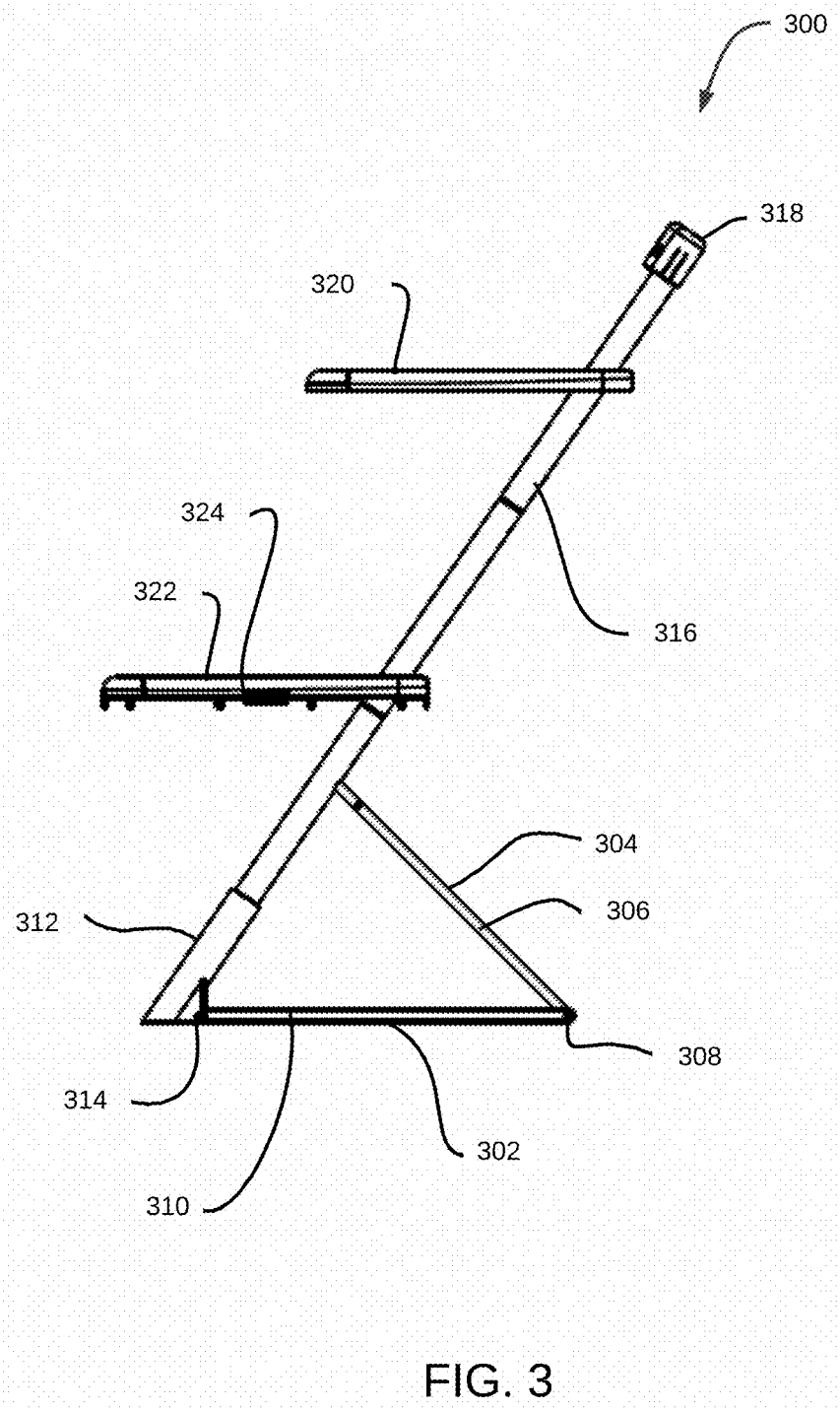
FIG. 3 shows a collapsible work stand with adjustable platforms in accordance with various aspects of the present disclosure.

FIG. 3 shows a platform support structure 300 which supports techniques for collapsible work stand with adjustable platforms in accordance with various aspects of the present disclosure. As depicted in FIG. 3, the platform support structure 300 may include one or more of a base structure 302, a base support 304, a second base support bar 306, a second base support hinge 308, a second base strut 310, a stanchion support 312, a second stanchion support hinge 314, a second stanchion 316, a stanchion connector 318, a first platform 320, a second platform 322, a second platform fastener 324, and/or other components.

The base structure 302 may serve as the foundational element of the platform support structure 300. The base structure 302 may be designed to provide a stable footing for the platform support structure 300. The base structure 302 may be configured to interact with the base support 304 to form a stable base for the stand.

The base support 304 may be a component that interacts with other parts of the platform support structure 300. The base support 304 may be designed to provide additional stability to the base structure 302.

The second base support bar 306 may be an integral part of the base support assembly within the platform support structure 300. The second base support bar 306 may be designed to reinforce the base support 304. The second base support bar 306 may be configured to work in conjunction with the second base support hinge 308 to allow for movement between deployment and storage.

The second base support hinge 308 may allow for pivotal movement of connected components in the platform support structure 300. The second base support hinge 308 may be designed to enable the second base support bar 306 to pivot. The second base support hinge 308 may be configured to work with the second base strut 310 to facilitate folding of the base.

The second base strut 310 may provide structural integrity to the platform support structure 300. The second base strut 310 may be designed to support the weight of the platforms and any items placed on them. The second base strut 310 may be configured to connect to the stanchion support 312 to maintain the stand's stability.

The stanchion support 312 may connect to other elements to maintain the stability of the platform support structure 300. The stanchion support 312 may be designed to anchor the stanchions in place. The stanchion support 312 may be configured to work with the second stanchion support hinge 314 to allow the stanchion support 312 to fold into a configuration for storage.

The second stanchion support hinge 314 may facilitate the folding and unfolding actions within the platform support structure 300. The second stanchion support hinge 314 may be designed to enable the stanchion support 312 to pivot. The second stanchion support hinge 314 may be configured to work with the stanchion support 312 to allow for collapsibility.

The second stanchion 316 may be one of the vertical supports in the platform support structure 300. The second stanchion 316 may be designed to extend vertically to support the platforms. The second stanchion 316 may be configured to connect to the stanchion connector 318 to maintain a parallel orientation with one or more other stanchions connected to the stanchion connector 318.

The stanchion connector 318 may join various components to ensure the cohesiveness of the platform support structure 300. The stanchion connector 318 may be designed to link the stanchions at their upper ends.

The first platform 320 may be positioned at a certain height within the platform support structure 300. The first platform 320 may be designed to support items at an ergonomic level for the user. The first platform 320 may be configured to adjust in height along the second stanchion 316 and/or other stanchions.

The second platform 322 may be another level within the platform support structure 300 where items can be placed. The second platform 322 may be designed to provide additional space for items below the first platform 320. The second platform 322 may be configured to adjust in height along the second stanchion 316 and/or other stanchions.

The second platform fastener 324 may secure the second platform 322 in a folded position for storage. The second platform fastener 324 may be designed to lock the second platform 322 in place once the second platform is folded. The second platform fastener 324 may be configured to engage with one or more other fasteners of the second platform 322 to prevent movement during storage.

In some implementations, the base structure 302 may be connected to the base support 304, which may include the second base support bar 306. The second base support hinge 308 may allow the second base support bar 306 to pivot, enabling the base structure 302 to fold when not in use. The second base strut 310 may connect to the stanchion support 312, which may be anchored by the second stanchion support hinge 314 to allow for collapsibility.

In some implementations, the second stanchion 316 may extend vertically from the stanchion support 312 and may be connected at its upper end by the stanchion connector 318. The first platform 320 may be adjustable along the second stanchion 316, while the second platform 322 may be secured at a desired height by the second platform height adjustment mechanism. The arrangement of these components may allow the platform support structure 300 to be both stable and adjustable for various uses.

Figure 4:
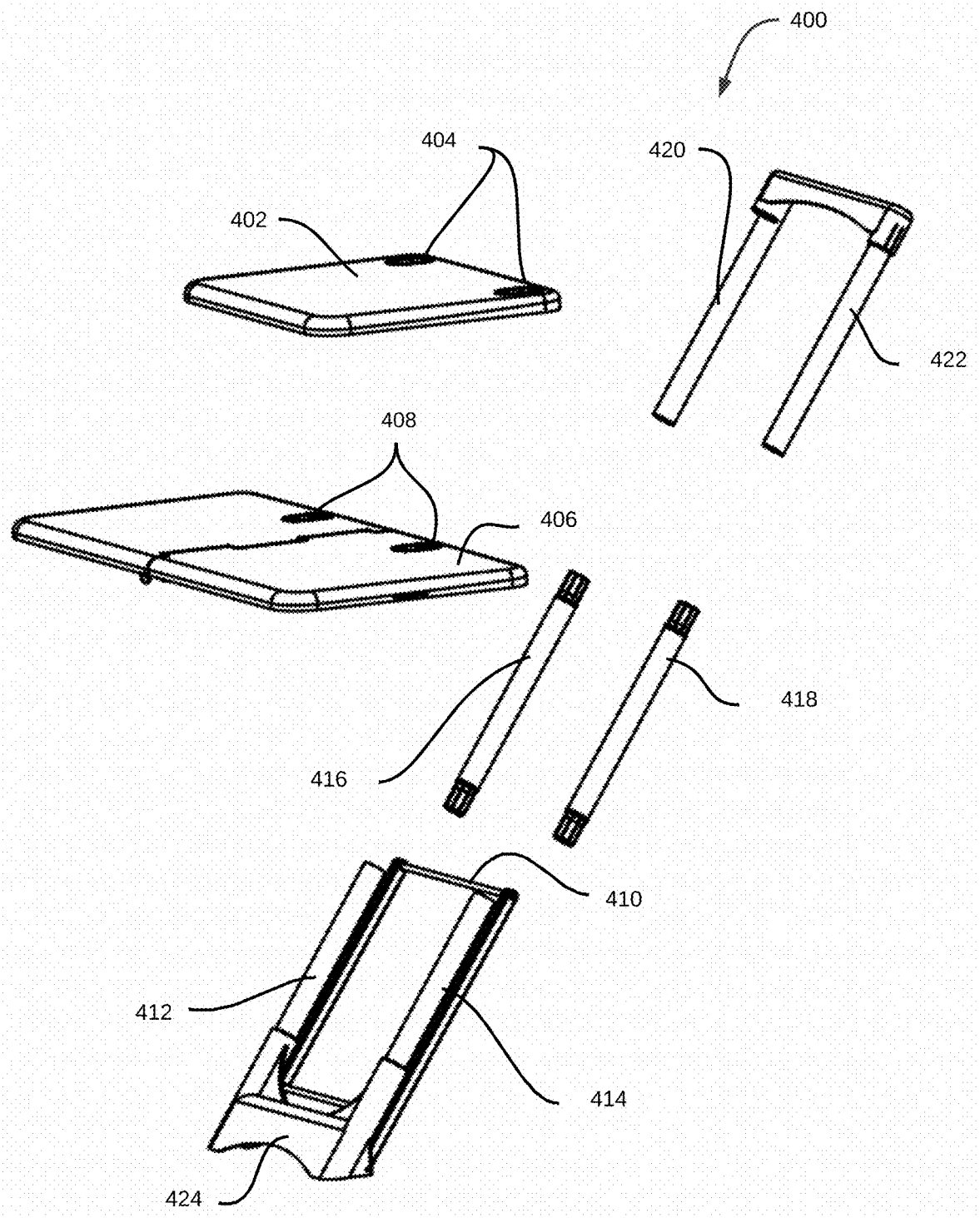
FIG. 4 shows a collapsible work stand with adjustable platforms in accordance with various aspects of the present disclosure.

FIG. 4 shows platform assembly components 400 which supports techniques for collapsible work stand with adjustable platforms and foldable base structure in accordance with various aspects of the present disclosure. As depicted in FIG. 4, the platform assembly components 400 may include one or more of a first platform 402, a first platform height adjustment mechanism 404, a second platform 406, a second platform height adjustment mechanism 408, a base support 410, a first stanchion segment 412, a second stanchion segment 414, a third stanchion segment 416, a fourth stanchion segment 418, a fifth stanchion segment 420, a sixth stanchion segment 422, a stanchion support 424, and/or other components.

The first platform 402 may serve as a support surface for electronic devices. The first platform 402 may be constructed from materials that provide a stable and flat surface for the devices. The first platform 402 may be designed to accommodate a range of device sizes and weights. In some implementations, the first platform 402 may be coated with a non-slip material to prevent devices from sliding off.

The first platform height adjustment mechanism 404 may enable the vertical positioning of the first platform 402 along the stanchions. The first platform height adjustment mechanism 404 may include a series of notches or grooves that interact with corresponding features on the stanchions to secure the platform at various heights. The first platform height adjustment mechanism 404 may be manually operated by the user to adjust the height of the first platform 402. In some implementations, the first platform height adjustment mechanism 404 may be designed to allow for smooth and precise adjustments.

The second platform 406 may provide an additional level for supporting various items. The second platform 406 may be positioned below the first platform 402 to create a multi-tiered arrangement. The second platform 406 may be sized differently from the first platform 402 to accommodate different types of items.

The second platform height adjustment mechanism 408 may allow for the adjustment of the second platform 406 height relative to the base. The second platform height adjustment mechanism 408 may operate independently of the first platform height adjustment mechanism 404. The second platform height adjustment mechanism 408 may include a locking feature to maintain the second platform 406 at the selected height. In some implementations, the second platform height adjustment mechanism 408 may be integrated into the design of the second platform 406 for a seamless appearance.

The base support 410 may stabilize the stand when deployed. The base support 410 may be weighted or designed with a wide footprint to increase stability. The base support 410 may be connected to the lower portion of the stanchions to distribute the weight of the platforms evenly. In some implementations, the base support 410 may include rubber or non-slip feet to prevent movement on smooth surfaces.

The first stanchion segment 412 may connect with other segments to form a stanchion. The first stanchion segment 412 may have connectors at each end to securely attach to adjacent segments. The first stanchion segment 412 may be the lowermost segment that interfaces with the stanchion support 424. In some implementations, the first stanchion segment 412 may be constructed from a material that provides both strength and lightness.

The second stanchion segment 414 may be joined with adjacent stanchion segments to extend the height of the stanchion. The second stanchion segment 414 may be identical to or different in length from the first stanchion segment 412. The second stanchion segment 414 may include a mechanism for locking it in place with the first stanchion segment 412.

The third stanchion segment 416 may link with other segments to create the full length of a stanchion. The third stanchion segment 416 may be designed for easy assembly and disassembly with other stanchion segments. The third stanchion segment 416 may be the middle segment in a series of stanchion segments. In some implementations, the third stanchion segment 416 may have a textured surface to enhance grip during assembly.

The fourth stanchion segment 418 may be part of the assembly that constitutes a stanchion. The fourth stanchion segment 418 may be interchangeable with other stanchion segments for flexible configuration. The fourth stanchion segment 418 may be designed to bear the load of the platforms without bending. In some implementations, the fourth stanchion segment 418 may feature a matte finish to reduce glare and improve aesthetics.

The fifth stanchion segment 420 may attach to other segments to complete the stanchion structure. The fifth stanchion segment 420 may be shorter or longer than other segments to adjust the overall height of the stanchion. The fifth stanchion segment 420 may be reinforced at the connection points for added durability.

The sixth stanchion segment 422 may be the final segment in the series that forms a stanchion. In some implementations, the sixth stanchion segment 422 may include a feature that allows for the attachment of accessories or additional components.

The stanchion support 424 may provide a connection point for the stanchion segments and the base. The stanchion support 424 may be designed to evenly distribute the weight of the stanchion and attached platforms. The stanchion support 424 may be constructed from a material that resists wear and tear. In some implementations, the stanchion support 424 may be shaped to allow for easy gripping during the assembly process.

In some implementations, the first platform 402 may be positioned at the top of the stanchion assembly, supported by the first platform height adjustment mechanism 404. The second platform 406 may be attached below the first platform 402, using the second platform height adjustment mechanism 408 to adjust its height. The base support 410 may be located at the bottom of the assembly, providing stability for the entire structure.

In some implementations, the stanchion segments, including the first stanchion segment 412, second stanchion segment 414, third stanchion segment 416, fourth stanchion segment 418, fifth stanchion segment 420, and sixth stanchion segment 422, may be connected to form two or more stanchions. In some implementations, the first stanchion segment 412, third stanchion segment 416, and fifth stanchion segment 420 may be connected to form a first stanchion. In some implementations, the second stanchion segment 414, fourth stanchion segment 418, and sixth stanchion segment 422 may be connected to form a second stanchion. The stanchion support 424 may connect the stanchion segments to the base support 410, ensuring the structure remains stable and secure.

Figure 5:
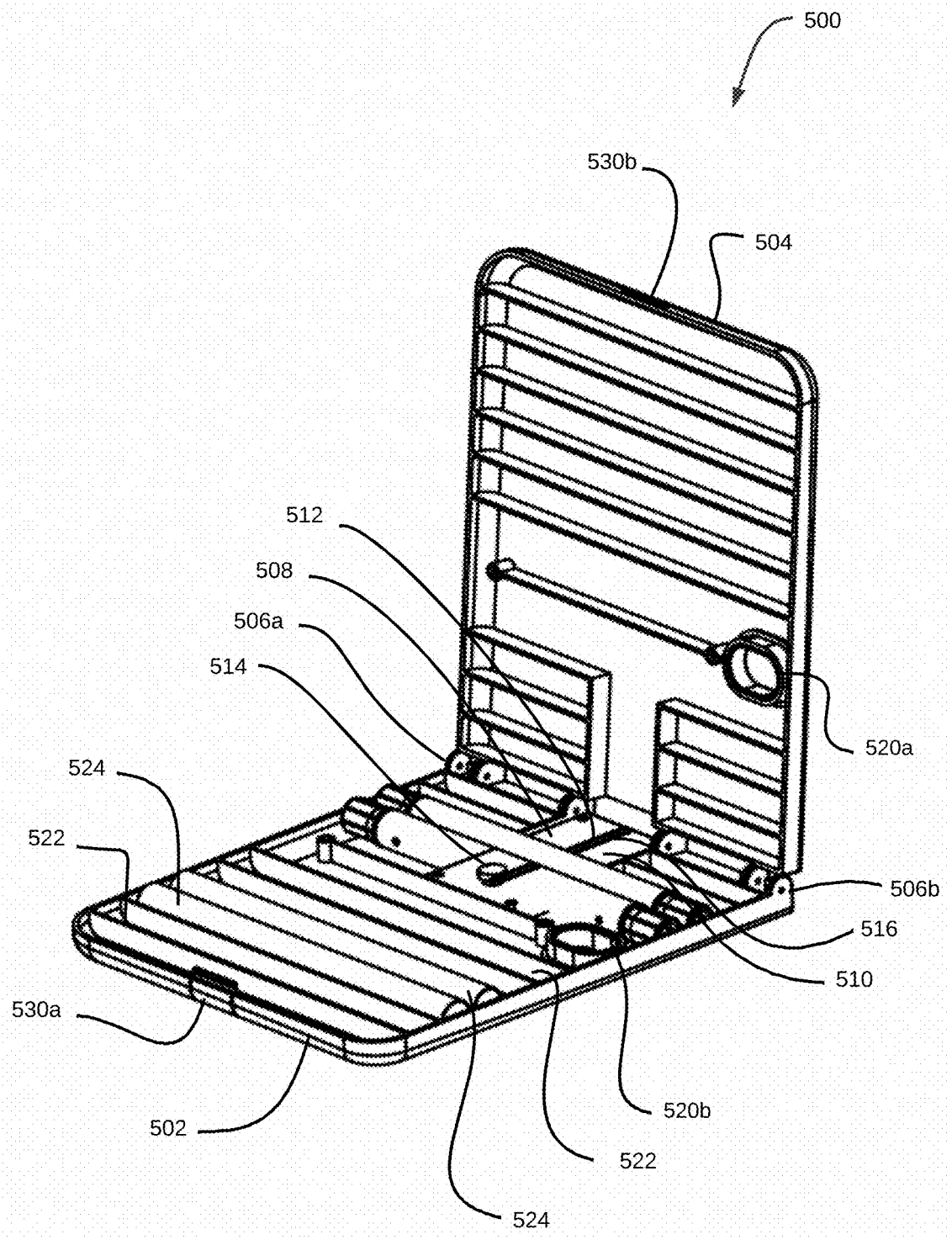
FIG. 5 shows a platform of a collapsible work stand with adjustable platforms in accordance with various aspects of the present disclosure.

FIG. 5 shows the underside of a second platform 500 which may be used by a collapsible work stand with adjustable platforms in accordance with various aspects of the present disclosure. As depicted in FIG. 5, the second platform 500 may include one or more of a first section 502, a second section 504, height adjustment mechanism 520*a-b*, and/or other components. The first section 502 and second section 504 may be pivotally connected by platform hinges 506*a-b*. The platform hinges 506*a-b* may provide a pivot point for the second platform 500 to fold. The second platform 500 may include a platform fastener 530*a-b* configured to secure the first section 502 and the second section 504 in the folded configuration. The platform fastener 530*a-b* may be a clasp, a magnet, and/or other fastening mechanism.

The second platform 500 may include a locking mechanism 508 to facilitate stabilizing the second platform 500 in a deployed position. The locking mechanism 508 may be positioned on the underside of the second platform 500. The locking mechanism 508 may include a slidable bar housing 510, a slidable bar 512, a knob 514, a track 516, and/or other components.

The slidable bar housing 510 may contain the slidable bar and facilitate its movement. The slidable bar housing 510 may be a channel or sleeve that holds the slidable bar 512 in alignment. The slidable bar housing 510 may be attached to the underside of the second platform 500 to support the movement of the slidable bar 512. In some implementations, the slidable bar housing 510 may be a cylindrical or rectangular enclosure that guides the slidable bar 512 as it moves.

The track 516 may guide the movement of components such as the knob 514 or slidable bar 512. The track 516 may be a linear path along which the knob 514 and slidable bar 512 travel. The track 516 may be integrated into the design of the stand to provide a controlled route for adjustments. In some implementations, the track 516 may be a groove or rail that directs the movement of the knob 514 and slidable bar 512 to specific positions. The knob 514 may include a threaded portion that facilitates tightening or locking the knob 514 and slidable bar 512 to specific position along the track 516.

The underside of second platform 500 may include one or more stanchion segment slots 522 for securing one or more stanchion segments 524 for compact storage. The stanchion segments 524 may be inserted and held within the stanchion segment slots 522 when the second platform 500 is in the folded configuration.

Figure 6:
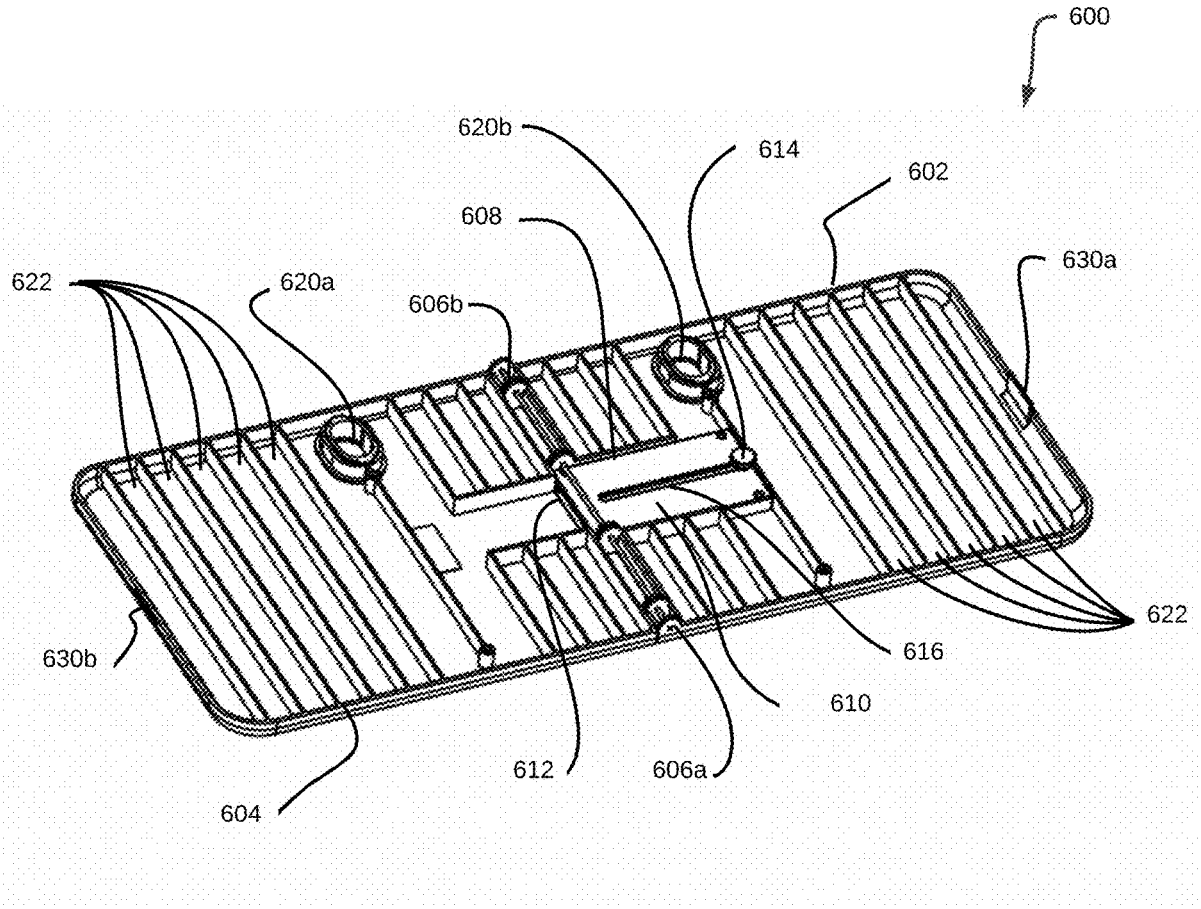
FIG. 6 shows a platform of a collapsible work stand with adjustable platforms in accordance with various aspects of the present disclosure.

FIG. 6 shows the underside of a second platform 600 which may be used by a collapsible work stand with adjustable platforms and foldable base structure in accordance with various aspects of the present disclosure. As depicted in FIG. 6, the adjustable platform mechanism 600 may include one or more of a first section 602, a second section 604, height adjustment mechanism 620*a-b*, and/or other components. The first section 602 and second section 604 may be pivotally connected by platform hinges 606*a-b*. The platform hinges 606*a-b* may provide a pivot point for the second platform 600 to fold. The second platform 600 may include a platform fastener 630*a-b* configured to secure the first section 602 and the second section 604 in the folded configuration. The platform fastener 630*a-b* may be a clasp, a magnet, and/or other fastening mechanism.

The second platform height adjustment mechanism 620*a-b* may include features that allow for the adjustment of the second platform's height. The second platform height adjustment mechanism 620*a-b* may be integrated into the design of the second platform to enable a user to modify the elevation of the platform relative to the base structure. The second platform height adjustment mechanism 620*a-b* may interact with the stanchions to achieve the desired height level. In some implementations, the second platform height adjustment mechanism 620*a-b* may be a series of interlocking components that engage with the stanchions to maintain the second platform at various heights.

The platform hinges 606*a-b* may provide a pivot point for the second platform 600 to fold. The platform hinges 606*a-b* may be located at a strategic position on the second platform to allow it to bend along a specific axis. The platform hinges 606*a-b* may be constructed from materials that can withstand repeated folding and unfolding actions. In some implementations, the platform hinges 606*a-b* may be a robust joint that connects the first section 602 and the second section 604 of the second platform, allowing them to move relative to each other.

The second platform 600 may include a locking mechanism 608 to facilitate stabilizing the second platform 600 in a deployed position. The locking mechanism 608 may be positioned on the underside of the second platform 600. The locking mechanism 608 may include a slidable bar housing 610, a slidable bar 612, a knob 614, a track 616, and/or other components. FIG. 6 illustrates the locking mechanism 608 in an unlocked configuration with slidable bar 612 retracted to facilitate folding of the second platform 600.

The knob 614 may be used to adjust the position or configuration of associated components. The knob 614 may be designed to be easily grasped and turned by the user to make adjustments. The knob 614 may be connected to other components, such as the slidable bar 612, such that movement of the knob 614 along the track 616 results in movement of the slidable bar 612. In some implementations, the knob 614 may be a circular or oval-shaped dial that can be slid to move connected components along the track 616.

The slidable bar 612 may move in conjunction with other components for adjustment purposes. The slidable bar 612 may be guided by the track 616 to ensure smooth and controlled movement. The slidable bar 612 may be connected to the knob 614 to facilitate adjustments made by the user. In some implementations, the slidable bar 612 may be a rod or shaft that slides within the slidable bar housing 610 as the knob 614 is slid along the track 616.

The slidable bar housing 610 may contain the slidable bar 612 and facilitate its movement. The slidable bar housing 610 may be a channel or sleeve that holds the slidable bar 612 in alignment. The slidable bar housing 610 may be attached to the underside of the second platform 600 to support the movement of the slidable bar 612. In some implementations, the slidable bar housing 610 may be a cylindrical or rectangular enclosure that holds the slidable bar 612 as it moves. The slidable bar housing 610 may contain an opening that facilitates connection of the knob 614 to the slidable bar 612 and the movement of the knob 614 with the slidable bar 612 along the track 616.

The track 616 may guide the movement of components such as the knob 614 or slidable bar 612. The track 616 may be a linear path along which the knob 614 and slidable bar 612 travel. The track 616 may be integrated into the design of the stand to provide a controlled route for adjustments. In some implementations, the track 616 may be a groove or rail that directs the movement of the knob 614 and slidable bar 612 to specific positions.

The stanchion segment slots 622 may be distributed along the underside of second platform 600 to provide multiple points of attachment for the stanchion segments. The stanchion segments may be inserted and held within the stanchion segment slots 622 when the second platform 600 is in the folded configuration.

Figure 7:
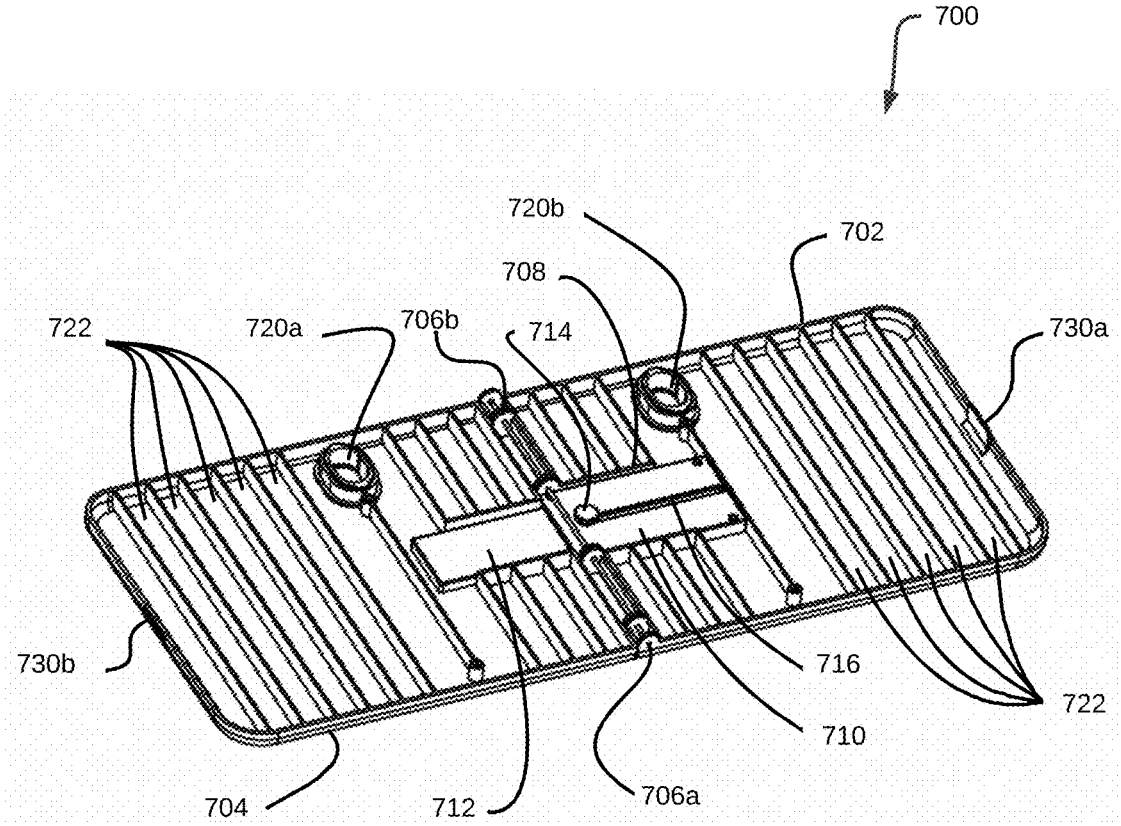
FIG. 7 shows a platform of a collapsible work stand with adjustable platforms in accordance with various aspects of the present disclosure.

FIG. 7 shows the underside of a second platform 700 which may be used by a collapsible work stand with adjustable platforms and foldable base structure in accordance with various aspects of the present disclosure. As depicted in FIG. 7, the second platform 700 may include one or more of a first section 702, a second section 704, height adjustment mechanism 720*a-b*, and/or other components. The first section 702 and second section 704 may be pivotally connected by platform hinges 706*a-b*. The platform hinges 706*a-b* may provide a pivot point for the second platform 700 to fold. The second platform 700 may include a platform fastener 730*a-b* configured to secure the first section 702 and the second section 704 in the folded configuration. The platform fastener 730*a-b* may be a clasp, a magnet, and/or other fastening mechanism.

The second platform height adjustment mechanism 720*a-b* may include features that allow for the adjustment of the second platform's height. The second platform height adjustment mechanism 720*a-b* may be integrated into the design of the second platform to enable a user to modify the elevation of the platform relative to the base structure. The second platform height adjustment mechanism 720*a-b* may interact with the stanchions to achieve the desired height level. In some implementations, the second platform height adjustment mechanism 720*a-b* may be a series of interlocking components that engage with the stanchions to maintain the second platform at various heights.

The platform hinges 706*a-b* may provide a pivot point for the second platform 700 to fold. The platform hinges 706*a-b* may be located at a strategic position on the second platform to allow it to bend along a specific axis. The platform hinges 706*a-b* may be constructed from materials that can withstand repeated folding and unfolding actions. In some implementations, the platform hinges 706*a-b* may be a robust joint that connects the first section 702 and the second section 704 of the second platform, allowing them to move relative to each other.

The second platform 700 may include a locking mechanism 708 to facilitate stabilizing the second platform 700 in a deployed position. The locking mechanism 708 may be positioned on the underside of the second platform 700. The locking mechanism 708 may include a slidable bar housing 710, a slidable bar 712, a knob 714, a track 716, and/or other components. FIG. 7 illustrates the locking mechanism 708 in a locked configuration with slidable bar 712 deployed to facilitate the deployed configuration of the second platform 700 and to prevent folding.

The knob 714 may be used to adjust the position or configuration of associated components. The knob 714 may be designed to be easily grasped and turned by the user to make adjustments. The knob 714 may be connected to other components, such as the slidable bar 712, such that movement of the knob 714 along the track 716 results in movement of the slidable bar 712. In some implementations, the knob 714 may be a circular or oval-shaped dial that can be slid to move connected components along the track 716.

The slidable bar 712 may move in conjunction with other components for adjustment purposes. The slidable bar 712 may be guided by the track 716 to ensure smooth and controlled movement. The slidable bar 712 may be connected to the knob 714 to facilitate adjustments made by the user. In some implementations, the slidable bar 712 may be a rod or shaft that slides within the slidable bar housing 710 as the knob 714 is slid along the track 716.

The slidable bar housing 710 may contain the slidable bar 712 and facilitate its movement. The slidable bar housing 710 may be a channel or sleeve that holds the slidable bar 712 in alignment. The slidable bar housing 710 may be attached to the underside of the second platform 700 to support the movement of the slidable bar 712. In some implementations, the slidable bar housing 710 may be a cylindrical or rectangular enclosure that holds the slidable bar 712 as it moves. The slidable bar housing 710 may contain an opening that facilitates connection of the knob 714 to the slidable bar 712 and the movement of the knob 714 with the slidable bar 712 along the track 716.

The track 716 may guide the movement of components such as the knob 714 or slidable bar 712. The track 716 may be a linear path along which the knob 714 and slidable bar 712 travel. The track 716 may be integrated into the design of the stand to provide a controlled route for adjustments. In some implementations, the track 716 may be a groove or rail that directs the movement of the knob 714 and slidable bar 712 to specific positions.

The stanchion segment slots 722 may be distributed along the underside of second platform 700 to provide multiple points of attachment for the stanchion segments. The stanchion segments may be inserted and held within the stanchion segment slots 722 when the second platform 700 is in the folded configuration.

Figure 8:
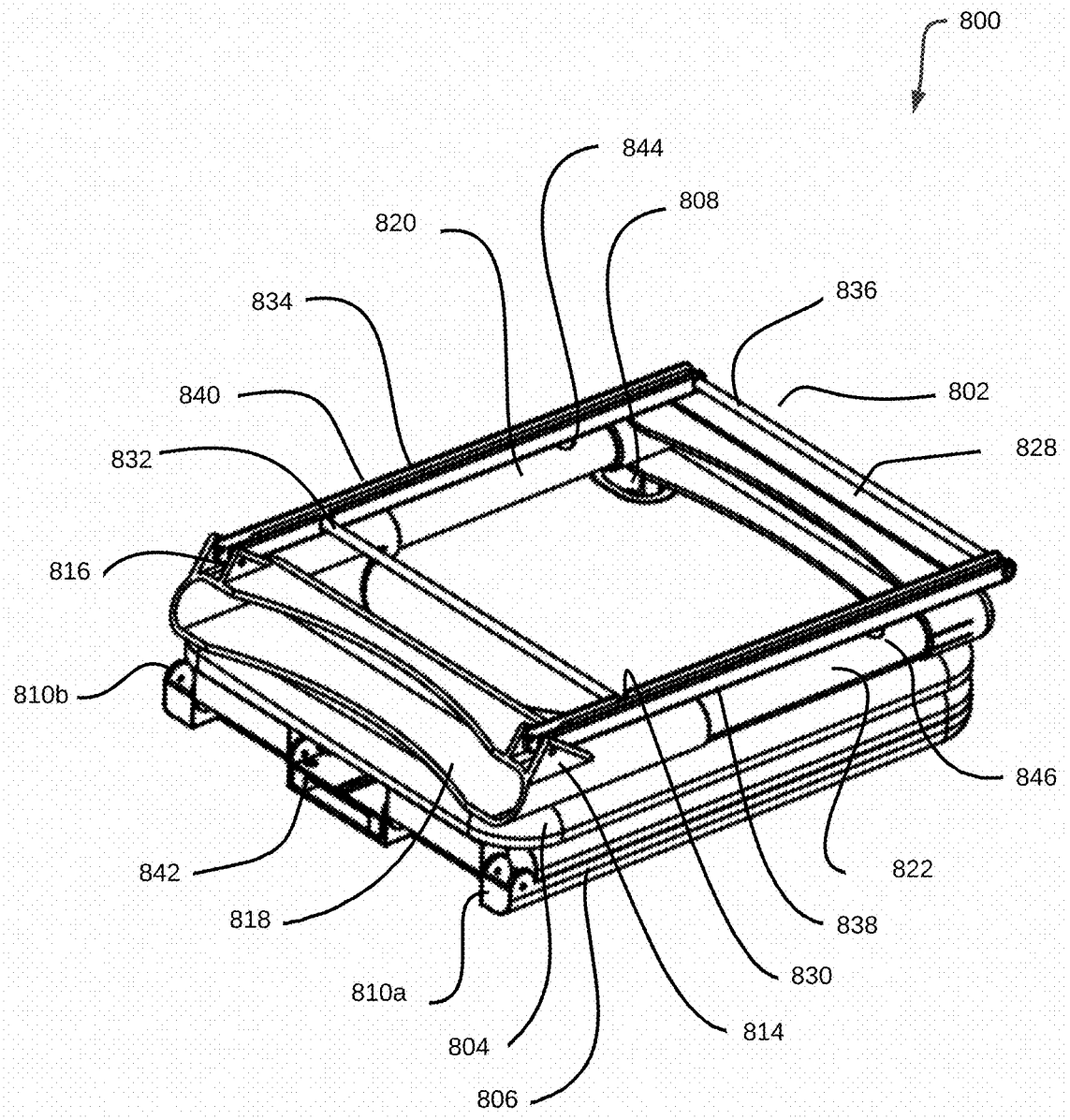
FIG. 8 shows a collapsible work stand with adjustable platforms in accordance with various aspects of the present disclosure.

FIG. 8 shows an adjustable platform assembly 800 which supports techniques for collapsible work stand with adjustable platforms and foldable base structure in accordance with various aspects of the present disclosure. As depicted in FIG. 8, the adjustable platform assembly 800 may include one or more of a base support 802, a first platform 804, a second platform 806, a first platform height adjustment mechanism 808, platform hinges 810*a-b*, a first stanchion support hinge 814, a second stanchion support hinge 816, a stanchion support 818, a first stanchion segment 820, a second stanchion segment 822, a stanchion connector 828, a first base support bar 830, a second base support bar 832, a first connecting base support bar 834, a second connecting base support bar 836, a first base strut 838, a second base strut 840, a locking mechanism 842, a first opening 844, a second opening 846, and/or other components.

The base support 802 may be a component of the adjustable platform assembly 800. The base support 802 may serve as the foundational element to which other components are attached. The base support 802 may include the base struts 838, 840 which form a stable base for the adjustable platform assembly 800. In some implementations, the base support 802 may be constructed from materials such as metal or reinforced plastic to provide the necessary support.

The first platform 804 may be a component of the adjustable platform assembly 800. The first platform 804 may provide a surface for supporting items such as a laptop. The first platform 804 may be positioned at a height suitable for user interaction with the supported items. In some implementations, the first platform 804 may be made of materials like metal, plastic, or composite to offer a sturdy and flat surface.

The second platform 806 may be a component of the adjustable platform assembly 800. The second platform 806 may offer additional space for supporting items below the first platform 804. The second platform 806 may be adjustable in height relative to the first platform 804. In some implementations, the second platform 806 may include features such as non-slip surfaces or edge guards to secure items placed on it.

The first platform height adjustment mechanism 808 may be a component of the first platform 804. The first platform height adjustment mechanism 808 may allow the first platform 804 to be raised or lowered. The first platform height adjustment mechanism 808 may interact with the stanchions to facilitate height adjustments. In some implementations, the first platform height adjustment mechanism 808 may include components such as locking pins, clamps, openings with friction lining to maintain the desired height of the first platform 804.

The platform hinges 810*a-b* may be components of the second platform 806. The platform hinges 810*a-b* may enable the second platform 806 to pivot or fold. The platform hinges 810*a-b* may be located at a position that allows the second platform 806 to move between a deployed and a stored position. In some implementations, the platform hinges 810*a-b* may be designed with a durable material to withstand repeated folding and unfolding actions. The platform hinges 810*a-b* may be integral to the compact storage of the adjustable platform assembly 800. In some implementations, the platform hinges 810*a-b* may be constructed to align with the folding mechanism of the second platform 806 for a smooth transition between positions.

The first stanchion support hinge 814 may be a component of the adjustable platform assembly 800. The first stanchion support hinge 814 may connect the first base strut 838 to the stanchion support 818. The first stanchion support hinge 814 may allow for the pivotal movement of the stanchion support 818 relative to the first base strut 838. In some implementations, the first stanchion support hinge 814 may be designed to facilitate the folding of the base structure for ease of transport.

The second stanchion support hinge 816 may be a component of the adjustable platform assembly 800. The second stanchion support hinge 816 may connect the second base strut 840 to the stanchion support 818. The second stanchion support hinge 816 may allow for the pivotal movement of the stanchion support 818 relative to the second base strut 840. In some implementations, the second stanchion support hinge 816 may be designed to facilitate the folding of the base structure for ease of transport.

The stanchion support 818 may be a component of the adjustable platform assembly 800. The stanchion support 818 may serve as the connecting point for the stanchion segments 820, 822. The stanchion support 818 may be designed to distribute the load evenly across the stanchion segments 820, 822 and/or stanchions formed of the stanchion segments 820, 822. In some implementations, the stanchion support 818 may be configured to lock the stanchion segments 820, 822 in place during use.

The first stanchion segment 820 may be a component of the adjustable platform assembly 800. The first stanchion segment 820 may form part of the vertical support structure for the platforms 804, 806. The first stanchion segment 820 may connect to the stanchion support 818 and extend upward to support the platforms 804, 806. The first stanchion segment 820 may be attached to one or more other stanchion segments to extend the height of the stanchion. In some implementations, the first stanchion segment 820 may be designed to telescopically extend and retract to adjust the height of the stanchion.

The second stanchion segment 822 may be a component of the adjustable platform assembly 800. The second stanchion segment 822 may be similar to the first stanchion segment 820 in providing vertical support. The second stanchion segment 822 may be attached to one or more other stanchion segments to extend the height of the stanchion. In some implementations, the second stanchion segment 822 may be designed to telescopically extend and retract to adjust the height of the stanchion.

In some implementations, the first stanchion segment 820, the second stanchion segment 822, and/or other stanchion segments may be constructed from lightweight yet strong materials such as aluminum or carbon fiber.

Figure 9:
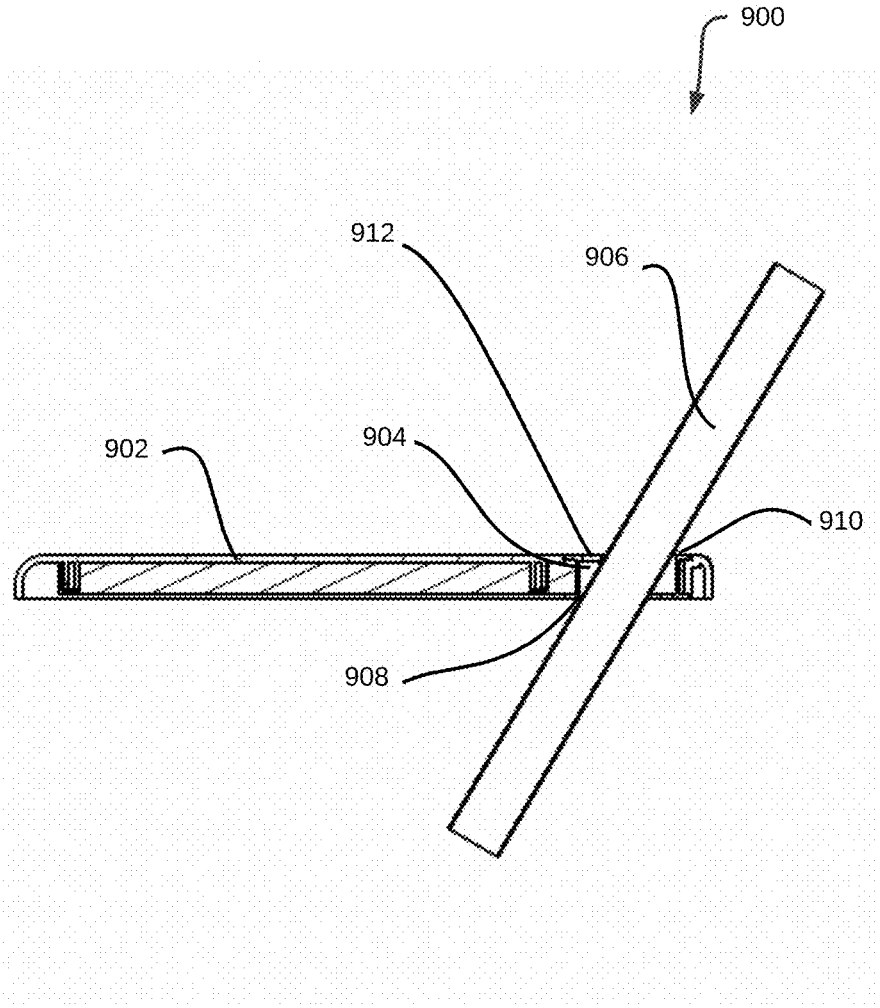
FIG. 9 shows a platform height adjustment mechanism which supports techniques for a collapsible work stand with adjustable platforms in accordance with various aspects of the present disclosure.

FIG. 9 shows a platform adjustment mechanism 900 which supports techniques for collapsible work stand with adjustable platforms and foldable base structure in accordance with various aspects of the present disclosure. As depicted in FIG. 9, the platform adjustment mechanism 900 may include one or more of a platform 902, a platform height adjustment mechanism 904, a stanchion segment 906, a first point of contact 908, a second point of contact 910, a platform height adjustment mechanism opening 912, and/or other components.

The platform 902 may represent the surface area on which objects can be placed. The platform 902 may be designed to accommodate various sizes and shapes of objects. The platform 902 may be constructed from materials that provide a stable and secure area for objects.

The platform height adjustment mechanism 904 may include features that allow for the vertical positioning of the platform 902. The platform height adjustment mechanism 904 may be integrated into the platform 902 to enable a range of height settings. The platform height adjustment mechanism 904 may interact with the stanchion segment 906 to adjust the height of the platform 902. The platform height adjustment mechanism 904 may be manually operated or may include automated features for adjusting the platform 902 height.

The stanchion segment 906 may form part of the support structure for the platform 902. The stanchion segment 906 may be constructed from materials that contribute to the overall stability and strength of the work stand. The stanchion segment 906 may be one of several segments that connect to form the complete stanchion.

The first point of contact 908 may engage with the platform 902 to maintain its position. The first point of contact 908 may be located at a strategic point on the platform 902 to provide effective support. The first point of contact 908 may be designed to interact with the platform 902 in a manner that prevents slippage or unwanted movement.

The second point of contact 910 may interact with the platform 902 to provide additional stability. The second point of contact 910 may be positioned to complement the first point of contact 908 in supporting the platform 902. The second point of contact 910 may be adjustable to accommodate different platform 902 positions and maintain stability at various heights.

The platform height adjustment mechanism opening 912 may accommodate the passage of the stanchion segment 906 for height adjustment purposes. The platform height adjustment mechanism opening 912 may be shaped to allow smooth movement of the stanchion segment 906 during height adjustments. The platform height adjustment mechanism opening 912 may include internal components that interact with the stanchion segment 906 to lock the platform 902 at the desired height.

In some implementations, the platform 902 may be positioned horizontally with the stanchion segment 906 extending at an angle to support the platform 902. The platform height adjustment mechanism 904 may interact with the stanchion segment 906 through the platform height adjustment mechanism opening 912. The first point of contact 908 may be situated at the underside of the platform 902, while the second point of contact 910 may be located at the opposite side, both engaging with the stanchion segment 906 to maintain stability.

Figure 10:
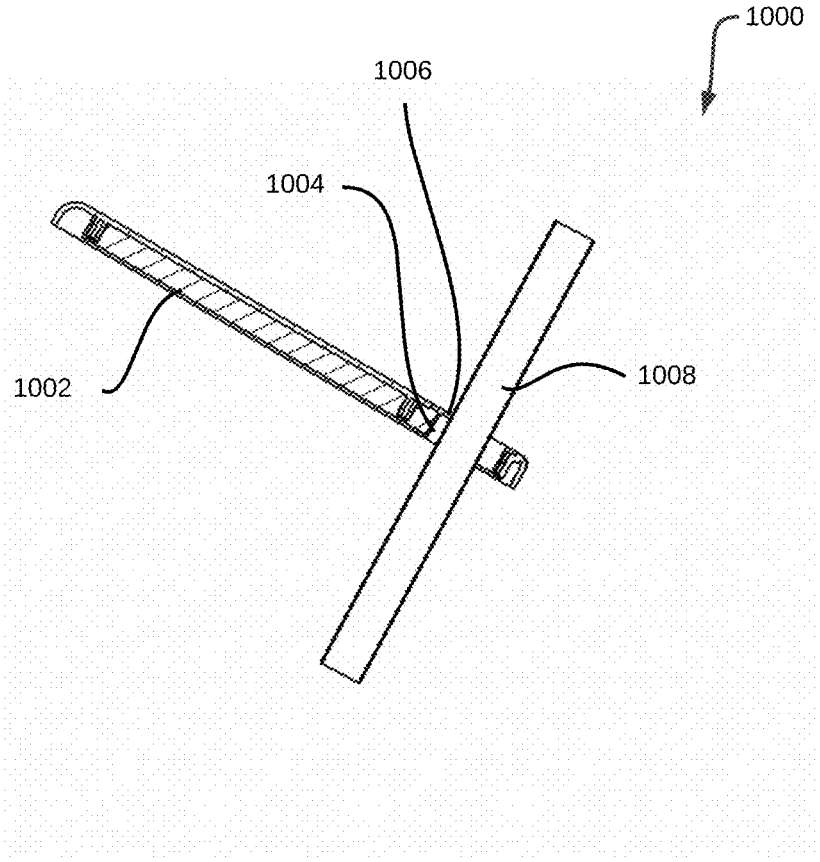
FIG. 10 shows a platform height adjustment mechanism which supports techniques for a collapsible work stand with adjustable platforms in accordance with various aspects of the present disclosure.

FIG. 10 shows a platform adjustment mechanism 1000 which supports techniques for collapsible work stand with adjustable platforms and foldable base structure in accordance with various aspects of the present disclosure. As depicted in FIG. 10, the platform adjustment mechanism 1000 may include one or more of a platform 1002, a platform height adjustment mechanism 1004, a platform height adjustment mechanism opening 1006, a stanchion segment 1008, and/or other components.

The platform 1002 may serve as a surface for supporting electronics or other items. The platform 1002 may be constructed from materials that provide a stable and flat surface for the items placed upon it. The platform 1002 may be designed to accommodate various sizes and shapes of electronic devices. In some implementations, the platform 1002 may be removable from the stanchion segment 1008 for ease of storage or transportation.

The platform height adjustment mechanism 1004 may allow for the vertical positioning of the platform 1002 along the stanchion segment 1008. The platform height adjustment mechanism 1004 may include a locking feature that maintains the platform 1002 at a selected height. The platform height adjustment mechanism 1004 may be manually operated to adjust the height of the platform 1002. In some implementations, the platform height adjustment mechanism 1004 may interact with the platform height adjustment mechanism opening 1006 to secure the platform 1002 in place.

The platform height adjustment mechanism opening 1006 may accommodate the passage of the stanchion segment 1008 through the platform 1002. The platform height adjustment mechanism opening 1006 may be lined with a material that increases friction to hold the platform 1002 in place. The platform height adjustment mechanism opening 1006 may be shaped to correspond with the cross-sectional profile of the stanchion segment 1008. In some implementations, the platform height adjustment mechanism opening 1006 may be part of the platform 1002 and may be positioned to allow for easy height adjustments.

The stanchion segment 1008 may provide structural support for the platform 1002 and may be part of the overall support structure of the collapsible work stand. The stanchion segment 1008 may be made from a rigid material that can support the weight of the platform 1002 and any items placed on it. The stanchion segment 1008 may be configured to interconnect with other stanchion segments to form a taller structure. In some implementations, the stanchion segment 1008 may be telescopic, allowing it to retract or extend to adjust the overall height of the work stand.

In some implementations, the platform 1002 may be positioned at an angle relative to the stanchion segment 1008. The platform height adjustment mechanism 1004 may be located near the intersection of the platform 1002 and the stanchion segment 1008. The platform height adjustment mechanism opening 1006 may be situated to allow the stanchion segment 1008 to pass through the platform 1002, enabling height adjustments.

Figure 11:
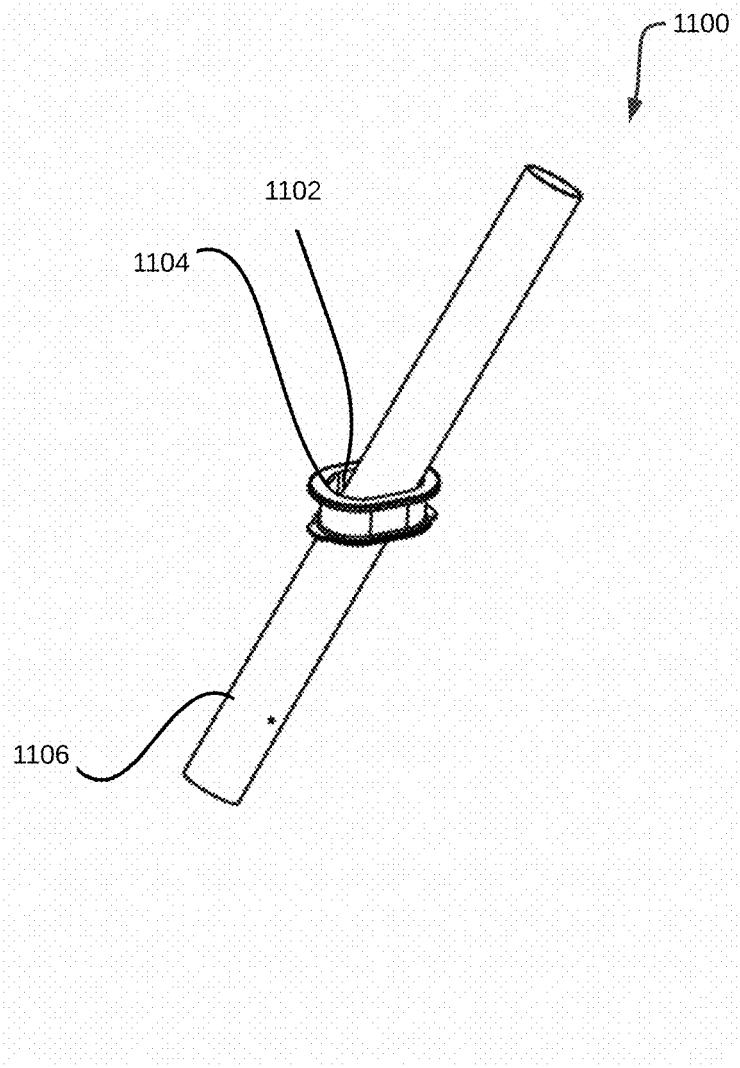
FIG. 11 shows a platform height adjustment mechanism which supports techniques for a collapsible work stand with adjustable platforms in accordance with various aspects of the present disclosure.

FIG. 11 shows an adjustment mechanism diagram 1100 which supports techniques for collapsible work stand with adjustable platforms and foldable base structure in accordance with various aspects of the present disclosure. As depicted in FIG. 11, the adjustment mechanism 1100 may include one or more of a friction lining 1102, a platform height adjustment mechanism 1104, a stanchion segment 1106, and/or other components.

The friction lining 1102 may provide a surface that interacts with other components to create resistance. The friction lining 1102 may be composed of a material that offers a high coefficient of friction. The friction lining 1102 may be strategically positioned to engage with the stanchion segment 1106. In some implementations, the friction lining 1102 may be replaceable to maintain the desired level of resistance over time. The friction lining 1102 may come in various textures and compositions to suit different environmental conditions or usage scenarios.

The platform height adjustment mechanism 1104 may include features that allow for the vertical positioning of a platform along the stanchion segment 1106. The platform height adjustment mechanism 1104 may consist of components that interact with the friction lining 1102 to maintain the platform at a selected height. The platform height adjustment mechanism 1104 may be manually operated by the user to adjust the platform height. In some implementations, the platform height adjustment mechanism 1104 may be designed to accommodate a range of platform sizes and weights. The platform height adjustment mechanism 1104 may incorporate a locking feature to secure the platform in place once the desired height is achieved.

The stanchion segment 1106 may represent a part of the structural support for the adjustable platforms. The stanchion segment 1106 may be constructed from materials that provide strength and stability to the overall stand structure. The stanchion segment 1106 may connect to the base structure and extend vertically to support the platforms. In some implementations, the stanchion segment 1106 may be designed to interlock with additional segments to achieve the required height. The stanchion segment 1106 may have a cross-sectional shape that complements the friction lining 1102 for effective interaction.

In some implementations, the friction lining 1102 may be positioned within the platform height adjustment mechanism 1104 to engage with the stanchion segment 1106. The platform height adjustment mechanism 1104 may include a first opening border and a second opening border that may encircle the stanchion segment 1106. The friction lining 1102 may be situated between the first opening border and the second opening border to create the necessary resistance for height adjustment.

Figure 12:
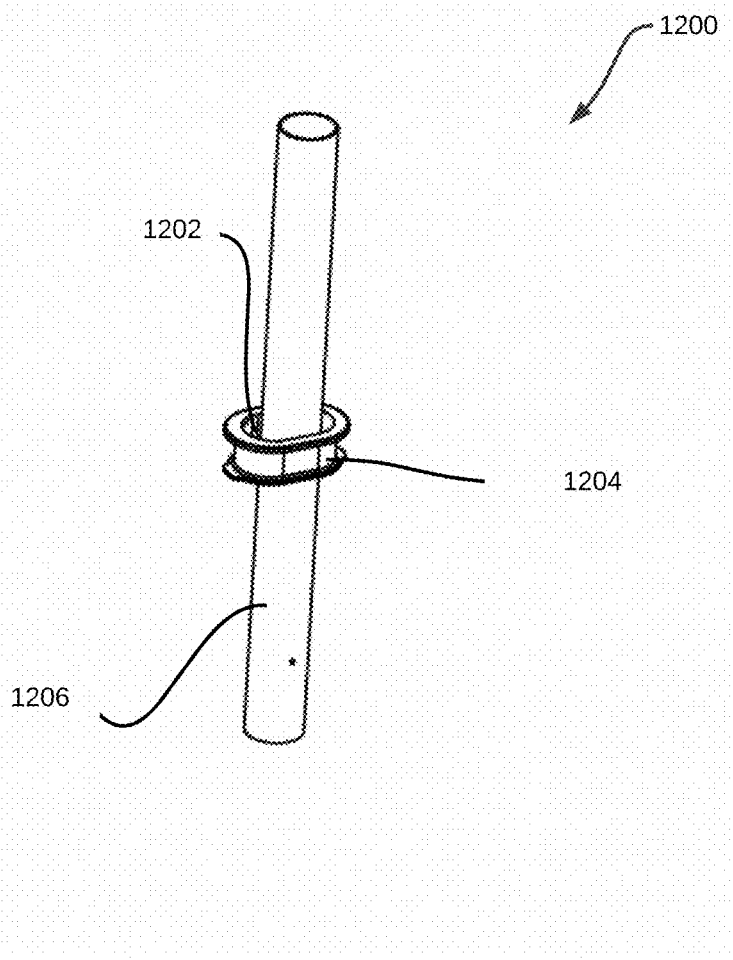
FIG. 12 shows a platform height adjustment mechanism which supports techniques for a collapsible work stand with adjustable platforms in accordance with various aspects of the present disclosure.

FIG. 12 shows a height adjustment mechanism 1200 which supports techniques for collapsible work stand with adjustable platforms and foldable base structure in accordance with various aspects of the present disclosure. As depicted in FIG. 12, the height adjustment mechanism 1200 may include one or more of a friction lining 1202, a platform height adjustment mechanism 1204, a stanchion segment 1206, and/or other components.

The friction lining 1202 may provide a surface that interacts with other components to maintain a desired position. The friction lining 1202 may be composed of a material that offers resistance when in contact with another surface. The friction lining 1202 may be attached to parts of the height adjustment mechanism 1200 that require stabilization. An example of the friction lining 1202 may be a rubberized coating, while an alternative could be a textured silicone pad.

The platform height adjustment mechanism 1204 may allow for the vertical movement of a platform along the stanchion segment 1206. The platform height adjustment mechanism 1204 may consist of components that slide or lock into place along the stanchion segment 1206. The platform height adjustment mechanism 1204 may interact with the friction lining 1202 to secure the platform at various heights. For instance, the platform height adjustment mechanism 1204 may include a series of notches or grooves that correspond with protrusions on the stanchion segment 1206.

The stanchion segment 1206 may form part of the structural support for the height adjustment mechanism 1200. The stanchion segment 1206 may be designed to interconnect with similar segments to achieve the desired height. The stanchion segment 1206 may have a surface that the friction lining 1202 can grip. As an illustrative example, the stanchion segment 1206 may be a cylindrical rod, while an alternative design may feature a square cross-sectional shape for added structural support.

In some implementations, the platform height adjustment mechanism 1204 may be positioned between a first opening border and a second opening border. The friction lining 1202 may be situated within the platform height adjustment mechanism opening to interact with the stanchion segment 1206. The stanchion segment 1206 may extend through the platform height adjustment mechanism opening, allowing the friction lining 1202 to engage with the stanchion segment 1206 to maintain the platform's height.

Figure 13:
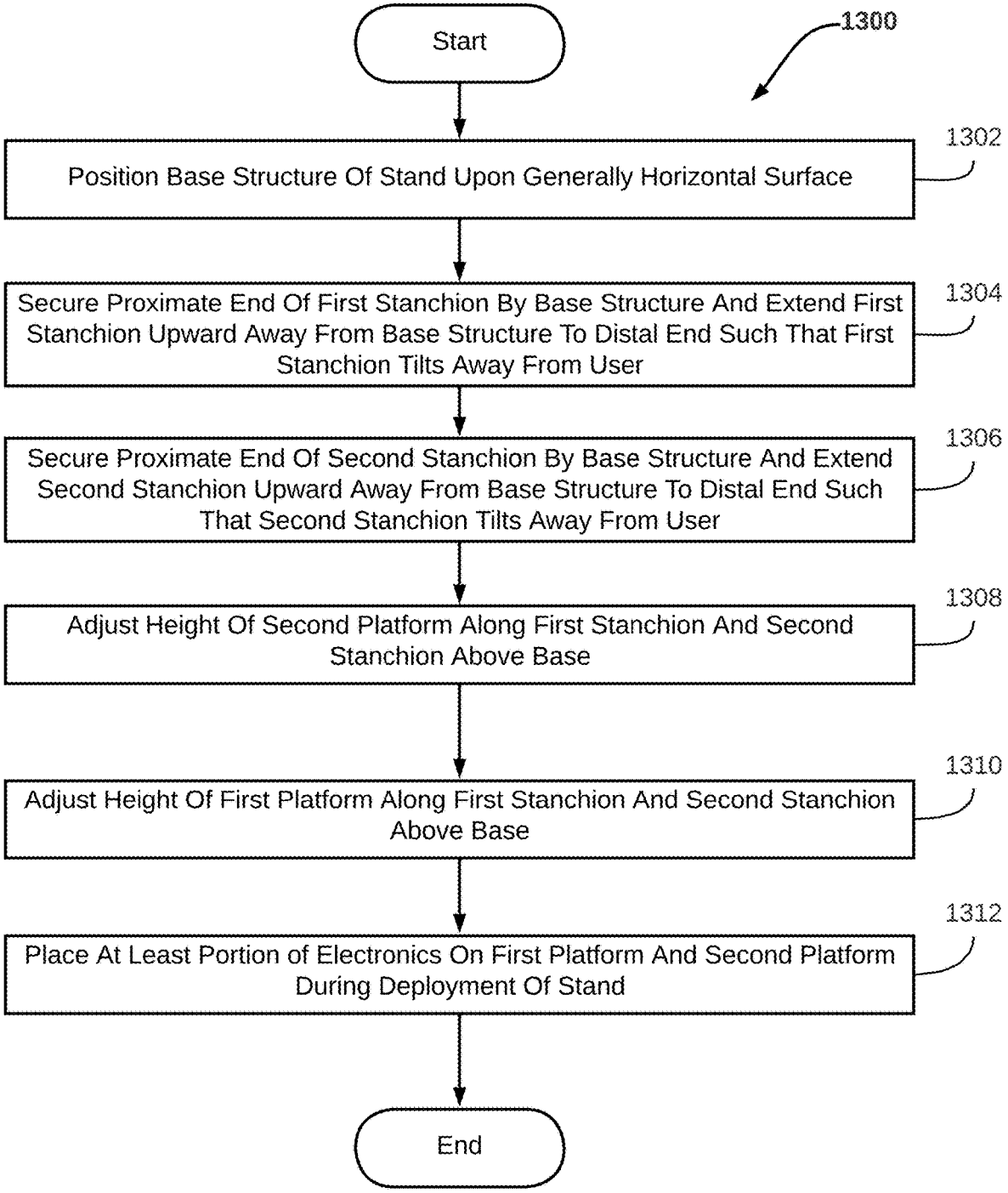
FIG. 13 shows a flowchart illustrating a method of using a collapsible work stand with adjustable platforms in accordance with various aspects of the present disclosure.

FIG. 13 shows a flowchart illustrating a method 1300 of using a collapsible work stand with adjustable platforms and foldable base structure in accordance with various aspects of the present disclosure.

At 1302, the method 1300 may include positioning a base structure of the stand upon a generally horizontal surface, wherein the base structure has a front end facing toward a side of the stand at which the user is positioned during use of the electronics and a rear end facing opposite the front end. The operations of 1302 may be performed in accordance with examples as disclosed herein. In some examples, aspects of the operations of 1302 may be performed by a base structure 102, a base structure 202, or a base structure 302 as described with reference to FIGS. 1, 2, and 3.

At 1304, the method 1300 may include securing a proximate end of a first stanchion by the base structure and extending the first stanchion upward away from the base structure to a distal end such that the first stanchion tilts away from the user. The operations of 1304 may be performed in accordance with examples as disclosed herein. In some examples, aspects of the operations of 1304 may be performed by a first stanchion 104, or a first stanchion 204 as described with reference to FIGS. 1 and 2.

At 1306, the method 1300 may include securing a proximate end of a second stanchion by the base structure and extending the second stanchion upward away from the base structure to a distal end such that the second stanchion is generally parallel with the first stanchion. The operations of 1306 may be performed in accordance with examples as disclosed herein. In some examples, aspects of the operations of 1306 may be performed by a second stanchion 106 or a second stanchion 206 as described with reference to FIGS. 1 and 2.

At 1308, the method 1300 may include adjusting the height of the second platform to a generally horizontal position along the first stanchion and the second stanchion above the base, wherein the adjustment is performed by a second platform height adjustment mechanism adapted to allow the horizontal position of the second platform to be adjustable along the lengths of the first stanchion and the second stanchion between the proximate and distal ends. The operations of 1308 may be performed in accordance with examples as disclosed herein. In some examples, aspects of the operations of 1308 may be performed by a second platform height adjustment mechanism 114*a-b* or a second platform height adjustment mechanism 214*a-b* as described with reference to FIGS. 1 and 2.

At 1310, the method 1300 may include adjusting the height of the first platform to a generally horizontal position along the first stanchion and the second stanchion above the base, wherein the adjustment is performed by a first platform height adjustment mechanism adapted to allow the horizontal position of the first platform to be adjustable along the lengths of the first stanchion and the second stanchion between the proximate ends and the distal ends. The operations of 1310 may be performed in accordance with examples as disclosed herein. In some examples, aspects of the operations of 1310 may be performed by a first platform height adjustment mechanism 110*a-b* or a first platform height adjustment mechanism 210*a-b* as described with reference to FIGS. 1 and 2.

At 1312, the method 1300 may include placing at least a portion of the electronics on a first platform and a second platform during deployment of the stand. The operations of 1312 may be performed in accordance with examples as disclosed herein. In some examples, aspects of the operations of 1312 may be performed by a first platform 108, a second platform 112, a first platform 208, and/or a second platform 212 as described with reference to FIGS. 1 and 2.

It should be noted that the methods described herein describe possible implementations, and that the operations and the steps may be rearranged or otherwise modified and that other implementations are possible. Furthermore, aspects from two or more of the methods may be combined.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form in order to avoid obscuring the concepts of the described examples.

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

What is claimed is:

1. A collapsable work stand configured to be deployed to hold electronics of a user during use of the electronics, the stand comprising:

a base structure configured to support the stand upon a generally horizontal surface during deployment of the stand, the base structure having a front end and a rear end, the front end facing toward a side of the stand at which the user is positioned during use of the electronics and the rear end facing opposite the front end;

a first stanchion having a distal end and a proximate end opposite the distal end, wherein during deployment the proximate end of the first stanchion is secured by the base structure with the first stanchion extending upward away from the base structure to the distal end such that the first stanchion tilts away from the user during use of the electronics;

a second stanchion having a distal end and a proximate end opposite the distal end, wherein during deployment the proximate end of the second stanchion is secured by the base structure with the second stanchion extending upward away from the base structure to the distal end such that the second stanchion is generally parallel with the first stanchion;

a first platform configured to hold at least a portion of the electronics during deployment;

a first platform height adjustment mechanism configured to hold the first platform in a generally horizontal position along the first stanchion and the second stanchion above the base, the first platform height adjustment mechanism being adapted so the horizontal position of the first platform is adjustable along the lengths of the first stanchion and the second stanchion between the proximate ends and the distal ends;

a second platform configured to hold at least a portion of the electronics during deployment; and a second platform height adjustment mechanism configured to hold the second platform in a generally horizontal position along the first stanchion and the second stanchion above the base, the second platform height adjustment mechanism being adapted so the horizontal position of the second platform is adjustable along the lengths of the first stanchion and the second stanchion between the proximate and distal ends;

wherein:

the first platform height adjustment mechanism includes two openings of the first platform that allow the first stanchion and the second stanchion to pass through respectively; and borders of the two openings of the first platform are lined with a material such that friction between the material contacting with the first stanchion and the second stanchion secures the first platform in the generally horizontal position.

2. The stand of claim 1, wherein the two openings of the first platform are shaped such that tilting the first platform releases the borders of the two openings from contact with the first stanchion and second stanchion and facilitates movement of the first platform along the lengths of the first stanchion and the second stanchion between the proximate ends and the distal ends.

3. The stand of claim 2, wherein returning the first platform to the generally horizontal position restores contact between the borders of the two openings and the first stanchion and the second stanchion to secure the first platform at the desired position along the lengths of the first stanchion and the second stanchion between the proximate ends and the distal ends.

4. The stand of claim 1, wherein the second platform height adjustment mechanism includes two openings of the second platform that allow the first stanchion and the second stanchion to pass through respectively.

5. The stand of claim 1, wherein the first stanchion and the second stanchion are telescopically extendible such that the first stanchion and the second stanchion are retracted during storage of the stand and extended during deployment of the stand.

6. The stand of claim 1, wherein the first stanchion and the second stanchion are formed of two or more connectible stanchion segments such that the two or more connectible stanchion segments are detached during storage of the stand and rigidly connected during deployment of the stand.

7. The stand of claim 1, wherein the first platform and the second platform are removable from the first stanchion and second stanchion during storage of the stand, and wherein the first platform is configured to stack atop the second platform with the second platform folded during storage.

8. The stand of claim 7, wherein the second platform is comprised of a first section and a second section connected by a hinge along which the second platform folds, the second platform including a locking mechanism positioned on an underside of the second platform, and wherein the locking mechanism includes a track positioned between the first section and the second section of the second platform and a knob that is slidable along the track, the knob having a threaded member that facilitates tightening of the knob along the track, and the knob being coupled with a slidable bar that moves along the track with the knob.

9. The stand of claim 1, wherein the base structure includes a first base support bar pivotally connected to a first base strut and a second base support bar pivotally connected to a second base strut, each base support bar including a first base support hinge for folding into a compact arrangement.

10. The stand of claim 1, wherein the second platform comprises a first fastener positioned on a first edge of the second platform, the first fastener configured to engage with a second fastener on a second edge of the second platform opposite the first edge responsive to the second platform being folded along a hinge of the second platform for storage.

11. A collapsable work stand configured to be deployed to hold electronics of a user during use of the electronics, the stand comprising:

a base structure configured to support the stand upon a generally horizontal surface during deployment of the stand, the base structure having a front end and a rear end, the front end facing toward a side of the stand at which the user is positioned during use of the electronics and the rear end facing opposite the front end;

a first stanchion having a distal end and a proximate end opposite the distal end, wherein during deployment the proximate end of the first stanchion is secured by the base structure with the first stanchion extending upward away from the base structure to the distal end such that the first stanchion tilts away from the user during use of the electronics;

a second stanchion having a distal end and a proximate end opposite the distal end, wherein during deployment the proximate end of the second stanchion is secured by the base structure with the second stanchion extending upward away from the base structure to the distal end such that the second stanchion is generally parallel with the first stanchion;

a first platform configured to hold at least a portion of the electronics during deployment;

a first platform height adjustment mechanism configured to hold the first platform in a generally horizontal position along the first stanchion and the second stanchion above the base, the first platform height adjustment mechanism being adapted so the horizontal position of the first platform is adjustable along the lengths of the first stanchion and the second stanchion between the proximate ends and the distal ends;

a second platform configured to hold at least a portion of the electronics during deployment; and a second platform height adjustment mechanism configured to hold the second platform in a generally horizontal position along the first stanchion and the second stanchion above the base, the second platform height adjustment mechanism being adapted so the horizontal position of the second platform is adjustable along the lengths of the first stanchion and the second stanchion between the proximate and distal ends wherein:

the second platform height adjustment mechanism includes two openings of the second platform that allow the first stanchion and the second stanchion to pass through respectively; and borders of the two openings of the second platform are lined with a material such that friction between the material contacting with the first stanchion and the second stanchion secures the second platform in the generally horizontal position.

12. The stand of claim 11, wherein the two openings of the second platform are shaped such that tilting the second platform releases the borders of the two openings from contact with the first stanchion and second stanchion and facilitates movement of the second platform along the lengths of the first stanchion and the second stanchion between the proximate ends and the distal ends.

13. The stand of claim 12, wherein returning the second platform to the generally horizontal position restores contact between the borders of the two openings and the first stanchion and the second stanchion to secure the second platform at the desired position along the lengths of the first stanchion and the second stanchion between the proximate ends and the distal ends.

14. The stand of claim 11, wherein the first platform and the second platform are removable from the first stanchion and second stanchion during storage of the stand, and wherein the first platform is configured to stack atop the second platform with the second platform folded during storage.

15. The stand of claim 14, wherein the second platform is comprised of a first section and a second section connected by a hinge along which the second platform folds, the second platform including a locking mechanism positioned on an underside of the second platform, and wherein the locking mechanism includes a track positioned between the first section and the second section of the second platform and a knob that is slidable along the track, the knob having a threaded member that facilitates tightening of the knob along the track, and the knob being coupled with a slidable bar that moves along the track with the knob.

16. The stand of claim 11, wherein the base structure includes a first base support bar pivotally connected to a first base strut and a second base support bar pivotally connected to a second base strut, each base support bar including a first base support hinge for folding into a compact arrangement.

17. The stand of claim 11, wherein the second platform comprises a first fastener positioned on a first edge of the second platform, the first fastener configured to engage with a second fastener on a second edge of the second platform opposite the first edge responsive to the second platform being folded along a hinge of the second platform for storage.

18. A method of using a collapsable work stand to hold electronics of a user, the method comprising:

positioning a base structure of the stand upon a generally horizontal surface, wherein the base structure has a front end facing toward a side of the stand at which the user is positioned during use of the electronics and a rear end facing opposite the front end;

securing a proximate end of a first stanchion by the base structure and extending the first stanchion upward away from the base structure to a distal end such that the first stanchion tilts away from the user;

securing a proximate end of a second stanchion by the base structure and extending the second stanchion upward away from the base structure to a distal end such that the second stanchion is generally parallel with the first stanchion;

adjusting the height of the first platform to a generally horizontal position along the first stanchion and the second stanchion above the base, wherein the adjustment is performed by a first platform height adjustment mechanism adapted to allow the horizontal position of the first platform to be adjustable along the lengths of the first stanchion and the second stanchion between the proximate ends and the distal ends; and adjusting the height of the second platform to a generally horizontal position along the first stanchion and the second stanchion above the base, wherein the adjustment is performed by a second platform height adjustment mechanism adapted to allow the horizontal position of the second platform to be adjustable along the lengths of the first stanchion and the second stanchion between the proximate and distal ends;

wherein:

the first platform height adjustment mechanism includes two openings of the first platform that allow the first stanchion and the second stanchion to pass through respectively during the adjusting of the height of the first platform, wherein the adjusting of the height of the first platform involves lining borders of the two openings of the first platform with a material such that friction between the material lining the borders of the two openings of the first platform and the first stanchion and the second stanchion secures the first platform in the generally horizontal position along the lengths of the first stanchion and the second stanchion; or the second platform height adjustment mechanism includes two openings of the second platform that allow the first stanchion and the second stanchion to pass through respectively during the adjusting of the height of the second platform, wherein the adjusting of the height of the second platform involves lining borders of the two openings of the second platform with a material such that friction between the material lining the borders of the two openings of the second platform and the first stanchion and the second stanchion secures the second platform in the generally horizontal position.

19. The method of claim 18, wherein the adjusting of the height of the first platform comprises tilting the first platform to release the borders of the two openings of the first platform from contact with the first stanchion and the second stanchion, thereby facilitating movement of the first platform along the lengths of the first stanchion and the second stanchion between the proximate ends and the distal ends, and wherein adjusting of the height of the first platform further comprises returning the first platform to the generally horizontal position to restore contact between the borders of the two openings of the first platform and the first stanchion and the second stanchion to secure the first platform at the desired position along the lengths of the first stanchion and the second stanchion between the proximate ends and the distal ends.

20. The method of claim 8, wherein the adjusting of the height of the second platform includes tilting the second platform to release the borders of the two openings of the second platform from contact with the first stanchion and the second stanchion, thereby facilitating movement of the second platform along the lengths of the first stanchion and the second stanchion between the proximate ends and the distal ends, and wherein the adjusting of the height of the second platform further comprises returning the second platform to the generally horizontal position to restore contact between the borders of the two openings of the second platform and the first stanchion and the second stanchion to secure the second platform at the desired position along the lengths of the first stanchion and the second stanchion between the proximate ends and the distal ends.

* * * * *